US010306374B2

(12) United States Patent
Kristensen et al.

(10) Patent No.: US 10,306,374 B2
(45) Date of Patent: May 28, 2019

(54) LISTENING DEVICE AND A METHOD OF MONITORING THE FITTING OF AN EAR MOULD OF A LISTENING DEVICE

(71) Applicant: OTICON A/S, Smørum (DK)

(72) Inventors: Michael Smed Kristensen, Smørum (DK); Michael Syskind Pedersen, Smørum (DK); Thomas Kaulberg, Smørum (DK)

(73) Assignee: Oticon A/S, Smørum (DK)

( * ) Notice: Subject to any disclaimer, the term of this patent is extended or adjusted under 35 U.S.C. 154(b) by 427 days.

(21) Appl. No.: 13/732,736

(22) Filed: Jan. 2, 2013

(65) Prior Publication Data

US 2013/0170660 A1 Jul. 4, 2013

Related U.S. Application Data

(60) Provisional application No. 61/582,503, filed on Jan. 3, 2012.

(30) Foreign Application Priority Data

Jan. 3, 2012 (EP) ..... 12150093

(51) Int. Cl.
*H04R 25/00* (2006.01)

(52) U.S. Cl.
CPC ..... *H04R 25/30* (2013.01); *H04R 25/305* (2013.01); *H04R 25/453* (2013.01); *H04R 25/554* (2013.01); *H04R 25/558* (2013.01); *H04R 2460/15* (2013.01)

(58) Field of Classification Search
CPC ..... H04R 25/30; H04R 25/305; H04R 25/65
See application file for complete search history.

(56) References Cited

U.S. PATENT DOCUMENTS 6,035,034 A * 3/2000 Trump ..... H04B 3/234 379/406.06
6,118,877 A * 9/2000 Lindemann ..... H04R 25/70 381/23.1
6,330,339 B1 * 12/2001 Ishige ..... H04R 25/502 381/312
7,269,262 B2 * 9/2007 Iseberg ..... A61B 5/121 381/60

(Continued)

FOREIGN PATENT DOCUMENTS

EP 1 465 454 A2 10/2004
EP 2 003 928 A1 12/2008

(Continued)

*Primary Examiner* — Sonia L Gay
(74) *Attorney, Agent, or Firm* — Birch, Stewart, Kolasch & Birch, LLP

(57) ABSTRACT

A method detects whether an ear mold of a listening device is correctly mounted in the ear of a user. An indication of whether or not a mold of a listening device is correctly mounted in an ear canal of a user is provided. The method comprises a) providing a long term estimate of the feedback path; b) providing an estimate of the current feedback path; c) comparing the long term feedback path estimate with the current feedback path estimate, and providing a measure of their difference, termed the feedback difference measure FBDM; and optionally d) providing an alarm indication, if the feedback difference measure exceeds a predefined threshold.

49 Claims, 13 Drawing Sheets

(56) References Cited

U.S. PATENT DOCUMENTS

| | | | | |
|---|---|---|---|---|
| 7,853,028 | B2 * | 12/2010 | Fischer | 381/312 |
| 7,933,419 | B2 * | 4/2011 | Roeck | H04R 25/70 381/314 |
| 2003/0161492 | A1 * | 8/2003 | Miller | H04R 25/453 381/326 |
| 2006/0285704 | A1 * | 12/2006 | Kitazawa | H04R 3/002 381/117 |
| 2008/0031480 | A1 * | 2/2008 | Barthel | H04R 25/00 381/316 |
| 2010/0166198 | A1 * | 7/2010 | Perman | H04R 25/453 381/60 |
| 2010/0183164 | A1 * | 7/2010 | Elmedyb | H04R 25/453 381/71.8 |
| 2010/0189269 | A1 | 7/2010 | Haartsen et al. | |
| 2010/0226516 | A1 * | 9/2010 | Grafenberg | H04R 25/305 381/318 |
| 2010/0254555 | A1 * | 10/2010 | Elmedyb | H04R 25/453 381/318 |
| 2010/0296680 | A1 * | 11/2010 | Korl et al. | 381/318 |
| 2013/0121494 | A1 * | 5/2013 | Johnston | H04R 1/1041 381/56 |

FOREIGN PATENT DOCUMENTS

| | | | |
|---|---|---|---|
| WO | WO 99/26453 | A1 | 5/1999 |
| WO | WO 2008/151970 | A1 | 12/2008 |
| WO | WO 2010/049543 | A2 | 5/2010 |

* cited by examiner

LISTENING DEVICE AND A METHOD OF MONITORING THE FITTING OF AN EAR MOULD OF A LISTENING DEVICE

TECHNICAL FIELD

The present application relates to leakage detection in listening devices comprising an in the ear (ITE) part adapted for being mounted fully or partially in an ear canal of a user. The disclosure relates specifically to a method of detecting whether an ear mould of a listening device is correctly mounted in the ear of a user. The application furthermore relates to a listening device and its use, and to a listening system.

The application further relates to a data processing system comprising a processor and program code means for causing the processor to perform at least some of the steps of the method.

The disclosure may e.g. be useful in applications such as hearing aids, headsets, ear phones, active ear protection systems.

BACKGROUND

The following account of the prior art relates to one of the areas of application of the present application, hearing aids.

Acoustic feedback occurs because the output loudspeaker signal from an audio system providing amplification of a signal picked up by a microphone is partly returned to the microphone via an acoustic coupling through the air or other media. The part of the loudspeaker signal returned to the microphone is then re-amplified by the system before it is re-presented at the loudspeaker, and again returned to the microphone. As this cycle continues, the effect of acoustic feedback becomes audible as artifacts or even worse, howling, when the system becomes unstable. The problem typically appears when the microphone and the loudspeaker are placed closely together, as e.g. in hearing aids. Some other typical situations with feedback problems relate to telephony, public address systems, headsets, audio conference systems, etc.

A particular problem occurs when the coupling conditions of a hearing aid to a user's ear canal is less than optimal, e.g. because the mounting of the hearing aid in the ear canal is less than optimal or because the ear canal changes over time. The former may e.g. occur for people who have difficulty to properly mount a mould of a listening device in the ear canal, and who may need help in mounting the mould and/or deciding on proper mounting. The latter is e.g. the case for children. Because the ears of children grow fast, it is important with a pre-warning by a leakage detector and possibly to lower the gain depending on the detected leakage.

It is known to apply a digital loop gain estimator in a DFC system (dynamic feedback cancellation), and also to realize a digital maximum gain limiter under control of the DFC. This feature is known as a fast online feedback manager. A fast and a slow online feedback managing system are e.g. described in WO 2008/151970 A1.

A method of monitoring a fit of a hearing device is described in WO 2010/049543 A2. The method comprises the steps of estimating a feedback measure reflecting behavior between a receiver and a microphone of the hearing device inserted into an ear, comparing the estimated feedback measure with a predetermined feedback measure, and indicating a misfit once the comparison of the estimated feedback measure with the predetermined feedback measure shows that the hearing device is not properly inserted into the ear canal of the hearing device user.

SUMMARY

An object of the present application is to provide an indication of whether or not a mould of a listening device is correctly mounted in an ear canal of a user. Another object is to provide a warning when a mould of a listening device has become or is becoming too small for an ear canal of a child.

Objects of the application are achieved by the invention described in the accompanying claims and as described in the following.

An 'ear mould' or 'mould' is in the present context taken to mean a device comprising a housing (e.g. of a plastic material) inserted into the ear, e.g. fully or partly into the ear canal, e.g. fully or partly into the bony part of the ear canal, of a person with the aim of delivering sound into the ear of the person. An ear mould may e.g. comprise a number of components (e.g. including a loudspeaker and possibly a microphone and/or a signal processing unit) of a listening device, e.g. a hearing aid. A mould may form part of a listening device (e.g. termed an 'in the ear (ITE) part') and be in (e.g. acoustic or electric) communication with other parts of the listening device or system (e.g. 'a behind the ear (BTE) part'). Alternatively, the mould (or ITE part) may constitute the listening device. An ear mould may comprise a wireless receiver or transceiver for establishing a (one- or two-way) wireless link to another device, e.g. to another part of the listening device (e.g. a BTE part), to another listening device (e.g. located at the other ear), to a remote control device or to another communication device, e.g. an audio selection device, etc. An ear mould may be specifically adapted to the anatomic form of the ear of the user wearing it. Alternatively it may have a standard form (e.g. selected among a number of differently sized standard forms).

A Method of Detecting Whether an Ear Mould of a Listening Device is Correctly Mounted or Appropriately Fitting in the Ear of a User:

In an aspect of the present application, an object of the application is achieved by a method of detecting whether an ear mould of a listening device is correctly mounted in the ear of a user, the listening device comprising a forward path between an input transducer for converting an input sound to an electric input signal and an output transducer for converting an electric output signal to a stimulus perceived by the user as an output sound, the forward path comprising a signal processing unit for applying a frequency dependent gain to the electric input signal or a signal originating therefrom and for providing a processed signal, and feeding the processed signal or a signal originating therefrom to the output transducer;

an analysis path for analysing a signal of the forward path and comprising a feedback estimation unit for estimating a feedback path from the output transducer to the input transducer. The method comprises, a) providing a long term estimate of the feedback path;

b) providing an estimate of the current feedback path;

c) comparing the long term feedback path estimate with the current feedback path estimate, and providing a measure of their difference, termed the feedback difference measure FBDM.

This has the advantage of providing a measure indicative of the current fitting of an ear mould of a listening device in the ear canal of the user.

The term 'a signal originating therefrom' is in the present context taken to mean a second signal that is derived from a first signal (the second signal 'originates from' the first signal), e.g. in that the second signal comprises the first signal (such as is equal to, or possibly having been added to a third signal) or constitutes an amplified or attenuated or otherwise modified version of the first signal.

The term 'long term feedback path estimate' is in the present context taken to mean an estimate of the feedback path when the listening device is properly mounted in the ear, where the estimate is 1) based on some sort of averaging over time of a number of instant (current) feedback path estimates (possibly subject to a classification according to their quality, focusing on estimates representing 'undisturbed' feedback situations, attempting to exclude feedback estimates originating from external events NOT representing the ear mould-to-ear canal coupling) or 2) a measured feedback path estimate, e.g. measured during a fitting procedure of the listening device to the person wearing the listening device. In an embodiment, the 'long term feedback path estimate' is a 'confident estimate of the true feedback path' (preferably representative of leakage only). In an embodiment, the 'long term feedback path estimate' is a 'reliable feedback path estimate'.

In an embodiment, the estimate of the current feedback path is based on the provision of a probe signal relayed to the environment of the listening device (e.g. played) by the output transducer (e.g. a loudspeaker).

In an embodiment, the method comprises providing the long term estimate of the feedback path and/or the current feedback path at a number NI of feedback calculation frequencies $f_1, f_2, \ldots, f_{NI}$.

In an embodiment, the method comprises processing a signal of the forward path and/or the analysis path in a number NP of processing channels, $CH_1, CH_2, \ldots, CH_{NP}$. Each channel $CH_j$ represents a different channel frequency range (possibly overlapping, and possibly of different width) defined by a frequency of the range, $f_{cj}$, j=1, 2, . . . , NP, e.g. a centre frequency, the number NP of processing channels being smaller than or equal to the number NI of feedback calculation frequencies. One value of the signal in question is determined in each channel. Each channel processing range may comprise a number (e.g. several) of said feedback calculation frequencies. At least some of the frequency channels correspond to more than one frequency band. The feedback path estimate of each channel is e.g. determined based on the values of the feedback path estimate at the feedback calculation frequencies within the channel frequency range in question, cf. e.g. FIG. 6.

In an embodiment, the number NI of feedback calculation frequencies $f_1, f_2, \ldots, f_{NI}$ corresponds to the number of (non-redundant) frequency bins of a Fourier transformation algorithm, e.g. a DFT algorithm such as an FFT algorithm ($FB_1, FB_2, \ldots, FB_{NI}$). In the present application the terms 'frequency bin' and 'frequency band' are used interchangeably to indicate a unit representing a frequency range by a single value of frequency. Typically the frequency bins or bands are of uniform width in frequency. Alternatively, they may be non-uniform (e.g. logarithmic) allowing non-linear frequency transformation (warping).

In an embodiment, estimated values of the long term feedback path $FBE_{LT}$ at a given frequency f, $FBE_{LT}(f)$, are stored in a memory of the listening device.

In an embodiment, the stored values of the long term feedback path $FBE_{LT}(f)$ comprise a measured feedback path estimate (e.g. at one or more, e.g. all, frequencies), e.g. measured during a fitting procedure of the listening device to the person wearing the listening device.

In an embodiment, the long term feedback path estimate $FBE_{LT}$ is based on some sort of updating algorithm, e.g. comprising averaging over time of a number of current feedback path estimates $FBE_{CUR}(t_1,f), FBE_{CUR}(t_2,f), \ldots, FBE_{CUR}(t_Q,f)$ where $t_q$ is a point in time, q=1, 2, . . . , Q, and f is frequency (cf. e.g. WO 2008/151970 A1). In an embodiment, the current feedback path estimates are classified according to their quality, and only the more reliable values of current feedback path estimates are used in the determination of long term feedback path estimates, cf. our co-pending European patent application EP12150097.9 entitled A method of improving a long term feedback path estimate in a listening device and filed on 3 Jan. 2012, and which is hereby incorporated by reference.

In an embodiment, the variance of the current feedback path estimates $FBE_{CUR}(t_1,f), FBE_{CUR}(t_2,f), \ldots, FBE_{CUR}(t_q,f)$ that are used to determine the long term feedback path estimate is determined for at least some of the frequencies f where the current feedback path is estimated. In an embodiment, the frequencies at which the current feedback path is estimated are ranked according to largest long term feedback estimates and/or smallest variance. In an embodiment, a number $N_T$ of frequencies to be included in a probe signal is taken from such list of ranked frequencies, e.g. the $N_T$ highest ranked frequencies.

In an embodiment, the feedback calculation frequency $f_{jp}$ (corresponding to a particular frequency band $FB_{jp}$) of a given processing channel $CH_j$ corresponding to a maximum value of the long term feedback path estimate is stored together with the maximum value $FBE_{LT,max,j}$ for channel $CH_j$ (cf. FIG. 7*b*).

In general the feedback path estimate $FBE(FB_{jp})$ for a given frequency $FB_{jp}$ is a complex value comprising a magnitude and a phase.

When determining the feedback difference measure, FBDM, typically the magnitude or magnitude squared (or the logarithm of such entities) of the feedback path estimates FBE(f) in question are used in the expression for the feedback difference measure.

In an embodiment, the feedback difference measure depends on the difference between the long term feedback path estimate ($FBE_{LT}(f)$) and the current feedback path estimate ($FBE_{CUR}(f)$) determined at a number ($N_{FBE}$) of frequencies comprising at least some, such as a certain fraction, such as a majority or all, of said feedback calculation frequencies $f_1, f_2, \ldots, f_{NI}$. In an embodiment, the feedback difference measure is determined as a sum of said differences, e.g.

$$FBDM=SUM[FBE_{LT}(f_i)-FBE_{CUR}(f_i)]\ [dB],\quad i=1,2,\ldots,N_{FBE},$$

where $FBE_{LT}(f_i)$ and $FBE_{CUR}(f_i)$ are assumed to be given in dB. Other difference measures or combinations of measures may alternatively be used, e.g. a weighted sum.

In an embodiment, the feedback difference measure is defined as a vector comprising the differences $FBE_{LT}(f_i)-FBE_{CUR}(f_i)$ at the frequencies $f_i$, i=1, 2, . . . , $N_{FBE}$. A threshold value $FBE_{TH}(f_i)$ may be defined for each frequency $f_i$. A criterion for indicating whether or not an ear mould is correctly mounted may be defined by said FBDM-vector and said threshold value vector $FBE_{TH}$. In an embodiment, the criterion for indicating whether or not an ear mould is correctly mounted depends on a number of individual criteria (e.g. $FBE_{LT}(f_i)-FBE_{CUR}(f_i)>FBE_{TH}(f_i)$, e.g. one or two or a majority or all being fulfilled, i=1, 2, . . . , $N_{FBE}$).

In general, the value of the feedback difference measure is only an indication of a potential problem, if FBDM is smaller than a threshold value $FBDM_{TH-NOK}$, e.g. if FBDM is negative, indicating a current feedback that is larger than the (expected) undisturbed (long term) feedback, e.g. 1) due to an incorrect mounting of a mould of a listening device or 2) due to a changed ear canal-mould fitting, e.g. a) typically due to growth of the ear canal (children) or b) to an exchange of the mould with a version with a decreased fitting (e.g. by a mistake). In an embodiment, $FBDM_{TH-NOK}=-3$ [dB].

In an embodiment, the feedback difference measure depends on the difference between the long term feedback path estimate and the current feedback path estimate determined in at least some, such as at a majority or all, of said processing channels, e.g. as a sum or a weighted sum of said differences. In an embodiment, the feedback difference measure is determined as a sum (e.g. a weighted sum) of said differences over all processing channels: ($SUM[FBE_{LT,max}(CH_j)-FBE_{CUR}(CH_j)]$, j=1, 2, . . . , NP). In an embodiment, the weights are adapted to depend on the user's hearing loss.

In an embodiment, only frequencies for which substantial feedback is expected to occur are considered for the determination of the feedback difference measure. In an embodiment, only predetermined frequencies are considered, e.g. based on measurements, e.g. during a fitting process, e.g. frequencies in the range from 1 kHz to 5 kHz. In an embodiment, the contributions of the feedback differences to the feedback difference measure are weighted with frequency dependent weights w(f), f being frequency. In an embodiment, $FBDM=SUM[w(f_i)\cdot(FBE_{LT}(f_i)-FBE_{CUR}(f_i))]$, $i=1-N_{FBE}$). In an embodiment, the frequency dependent weights are relatively larger at frequencies where substantial feedback is expected to occur. Other difference measures may be used, possibly weighted correspondingly. In an embodiment, relatively smaller weights w(f) are used below and/or above predefined low and high frequency thresholds $f_{THL}$ and $f_{THH}$, respectively. In an embodiment, the frequencies considered for the determination of the feedback difference measure are selected with a view to a users hearing ability, e.g. the user's hearing thresholds HT(f), f being frequency. In an embodiment, relatively larger weights are applied at a given frequency, the higher the user's hearing threshold is at that frequency.

In an embodiment, the long term feedback path estimate and/or the current feedback path estimate are based on an adaptive algorithm of the feedback estimation unit.

In situations, where no current feedback path estimate is available, e.g. in connection with a power-up procedure (where the listening device has been turned off or powered down for a shorter or longer period of time) a special current feedback estimate is needed.

In an embodiment, the (special) current feedback path estimate is based on an open loop estimation where a probe signal is played by a loudspeaker of the listening device (e.g. said output transducer) and the resulting current feedback path is estimated by an adaptive algorithm (e.g. an adaptive algorithm of the feedback estimation unit). This has the advantage that feedback howl cannot occur during the feedback path estimation.

In an embodiment, the probe signal comprises one or more tones located at one or more predefined frequencies $f_1$, $f_2$, . . . , $f_{NT}$. In an embodiment, the probe signal comprises one or more sine tones. An advantage of using one or more sine tones at predefined frequencies in the estimation of the current feedback path is that the estimation at the frequency in question is fast and precise. Alternatively, using a broadband probe signal (e.g. a white noise signal) would provide an estimate over the full frequency range, but at the cost of a longer estimation time. In the present case, where the tone frequencies $f_1$, $f_2$, . . . , $f_{NT}$ are or can be specifically selected to represent frequencies where feedback is the more likely to occur, a fast and reliable current feedback estimate at relevant frequencies is provided.

In an embodiment, the probe signal comprises one or more tones located at one or more of said feedback calculation frequencies $f_1$, $f_2$, . . . , $f_{NI}$, where the current feedback path is estimated.

In an embodiment, at least some of, such as a majority of or all, the tones of the probe signal are located where feedback is largest (or expected to be largest), e.g. above a predefined threshold value. In an embodiment, few, e.g. no, tones are located in frequency ranges where no or very little feedback occurs (or is expected to occur), e.g. where feedback is smaller than a predefined value.

In an embodiment, at least some of, such as a majority of or all, the tones are located in frequency ranges where the feedback path changes (or is expected to change) during use of the listening device. In an embodiment, few, e.g. no, tones are located in frequency ranges where the feedback path does not change (or is not expected to change) during use of the listening device.

In an embodiment, the density of tones (number of tones divided by the frequency range where the tones occur) is larger above a predefined threshold frequency $f_{TH}$. In an embodiment, said threshold frequency $f_{TH}$ is 3 kHz. In an embodiment, the probe signal comprises no tones below 1 kHz. In an embodiment, the density of tones is largest where feedback is largest, e.g. extracted from the smallest gain margin (IGmax−requested gain), e.g. 2-4 kHz. Preferably, the frequency range where feedback is largest is adapted to the particular user in question, e.g. individualized by measurement, or e.g. according to type of person (child, adult). In an embodiment, the frequency range where feedback is largest is estimated from stored long term feedback values (e.g. adapted over time).

In the present context, $IG_{max}$ is taken to mean the (frequency dependent) maximum gain value that may be applied to an input signal. $IG_{max}$ is determined with a view to feedback to avoid instability. $IG_{max}(f)$ values for each frequency or channel are e.g. determined from predetermined values of open loop gain $LG_{max}(f)$ of a loop comprising a forward path from an input transducer to an output transducer, the forward path comprising a gain element for providing a gain IG (including the insertion gain and any other gain in the forward path, e.g. possible gain in the input and output transducers), and an external feedback path from the output transducer to the input transducer providing a feedback gain FBG. In other words, LG=IG+FBG, i.e. IG=LG−FBG in a logarithmic representation, so $IGmax=LG_{max}-FBG_{max}$). Predefined maximum loop gain values $LG_{max}(f)$ are e.g. determined from an estimate of the maximum allowable loop gain before howling occurs ($LG_{howl}$) diminished by a predefined safety margin (gain margin GM, so $LG_{max}=LG_{howl}-GM$, and $IGmax=LG_{howl}-GM-FBG_{max}$). Predefined maximum gain values IGmax(f) are e.g. based on the predefined maximum loop gain values $LG_{max}(f)$ (and gain margins GM(f)) and on assumptions (or measurements) of maximum predictable feedback gain values, $FBG_{max}(f)$, (such values being dependent on the type of hearing aid, the size of a possible vent, the user's ear canal, etc.). At a given point in time, the gain $IG_{req}(f,t)$ requested by the listening device according to the user's hearing impairment, the current acoustic environment, input level, etc., will thus—if larger than IGmax—be limited to IGmax (providing a resulting gain $IG_{res}$, so $IG_{res}$=MIN($IG_{req}$,IGmax).

In an embodiment, the probe signal comprises a number of tones located at the frequencies exhibiting the largest long term feedback path estimates (the probe signal being e.g. activated in connection with a power-up procedure, where no current feedback estimate is (yet) available), e.g. allowing several tones to be located in the same frequency channel, or alternatively, each tone being located in a different frequency channel, e.g. assuming NT<NP. Alternatively or additionally, the probe signal comprises a number of tones located at the frequencies exhibiting the smallest gain margin GM(f). The gain margin GM(f) is e.g. identified by measurement of feedback in connection with a fitting procedure in advance of operational use of the listening device. The gain margins may alternatively or additionally be modified based on possible modified (updated) maximum long term feedback path estimates.

In an embodiment, at least some of, such as a majority of or all, the tones are located in frequency ranges where the requested gain (according to a user's hearing impairment) is the largest.

In an embodiment, the probe signal comprises a number of tones located at the frequencies exhibiting the largest, e.g. the 2-5 largest, long term feedback path estimates. In an embodiment, the probe signal comprises a number of tones located in the same frequency channel at the frequencies exhibiting the largest, e.g. the 2-5 largest, peaks of the long term feedback path estimate. In an embodiment, the method comprises an algorithm for identifying a peak in a dependent variable (e.g. feedback estimate) in a particular range of the independent variable (e.g. frequency).

In an embodiment, the probe signal comprises a tone located at the feedback calculation frequency $f_{jp}$ (frequency band $FB_{jp}$) for processing channel $CH_j$ corresponding to a maximum value of the long term feedback path estimate $FBE_{LT,max,j}$ for that channel. In an embodiment, the probe signal comprises one such tone for each processing channel $CH_j$, j=1, 2, . . . , NP. In an embodiment, the probe signal comprises more than one tone located in the same frequency channel, e.g. including the tone corresponding to maximum feedback path estimate, e.g. including one or more tones corresponding to the next largest maximum feedback path estimates or corresponding to the next largest separate peak(s) in the feedback path estimate.

In an embodiment, the tones are played one at a time (with a predefined spacing in time, as a sequence of tones) or a few tones simultaneously (a sum of tones), if the tones are well separated in frequency (e.g. more than 500 Hz apart), or a combination thereof. In an embodiment, a first selected tone of frequency $f_1$ is played at a first time $t_1$, and a second selected tone of frequency $f_2$ is played at a first time $t_2$. In an embodiment, the time interval ($\Delta t=t_2-t_1$) between the playing of the first and second tones is sufficiently long that the feedback path estimate at the first frequency $f_1$ has converged. In an embodiment, a first, relatively large adaptation rate $AR_1$ (e.g. step size $\mu_1$ of the adaptive algorithm) is used during an initial, first part of the time interval $\Delta t$ (to allow a relatively fast initial adaptation towards the end value), and a second relatively smaller adaptation rate $AR_2$ (e.g. step size $\mu_2$) is used during a second part of the time interval $\Delta t$ (to provide a more accurate adaptation towards the end value). In an embodiment, the variance of the feedback estimate during the second part of the time interval is determined. In an embodiment, the feedback estimate is considered not reliable, if the variance of a given feedback estimate (at a given frequency) is larger than a predetermine threshold value ($var_{TH}$), a relatively large variance value indicating a relatively large background noise. In such case, the measurement may be repeated one or more times, until a reliable value is provided (or until a maximum number of measurements have been performed).

In an embodiment, the tones are composed to form a melody (or jingle). In an embodiment, the melody—in addition to be used to measure the current feedback path—also indicates a specific status or event of the listening device (e.g. a start-up melody, indicating to the user that the listening device is in the process of being initialized and/or to be fully functional, when the melody terminates).

In an embodiment, the probe signal (e.g. a melody) is adapted to be played (e.g. by looping (i.e. persist)), possibly by repeating itself until it is detected that the mould of the listening device has been correctly mounted. In this embodiment, the persistence of the probe signal is an (indirect) indication to the user is that the ear mould is not (yet) correctly mounted.

In an embodiment, the probe signal is adapted to be played for a certain predefined amount of time. In an embodiment, said predefined time is larger than 15 s, such as larger than 30 s. In an embodiment, the predefined time is smaller than 300 s, e.g. smaller than 100 s, e.g. smaller than 60 s.

In an embodiment, the probe signal is adapted to be played for a certain predefined amount of time, or until it is detected that the mould of the listening device has been correctly mounted.

In an embodiment, an indication of the correct or incorrect mounting of the ear mould is indicated to the user at the termination of the playing of the probe signal via the output transducer (e.g. a loudspeaker) of the listening device, e.g. as two different beeps (or as one or two beeps, respectively, or any other indication that does or does not require a specific alarm indication unit).

In an embodiment, a convergence algorithm is applied for deciding when the estimate of current feedback based on an applied probe signal has converged (thereby providing a measurement end-time, and thus (possibly) an end-time of activation of the probe signal generator). In an embodiment, the convergence algorithm comprises comparing values of the current feedback path estimate at a given time and frequency instant (t,f) with values the feedback path estimate at a previous time instant (t−1,f). In an embodiment, the convergence algorithm comprises monitoring the sign of the difference between said feedback estimates at consecutive time instances. In an embodiment, the convergence algorithm comprises counting (from a measurement start time) the number of times ($N_{inc}$(f)) the later estimate is larger than the earlier estimate AND the number of times ($N_{dec}$(f)) the earlier estimate is larger than the later estimate. In an embodiment, the convergence algorithm comprises determining an end time of measurement (concluding that the measurement of the current feedback path has converged) when $N_{inc}$(f) AND $N_{dec}$(f) are larger than predefined numbers $N_{inc,stop}$(f) AND $N_{dec,stop}$(f), respectively.

In case the fitting conditions are changed (or in case the result of the measurement is otherwise inconclusive) during or after the measurement, the measurement is preferably repeated (e.g. a number of times). Such restart of the measurement may form part of a predefined or adaptive start-up procedure or may be initiated via a user interface, etc.). The accumulated (necessary) measurement time is thereby correspondingly increased.

In an embodiment, the probe signal is applied in a particular mode of the listening device, e.g. as part of a start-up procedure, or at the request of a user or a caring person, or an audiologist, e.g. via a user or programming interface, e.g. a remote control.

In an embodiment, the probe signal is activated in connection with a power-up of the listening device. The current feedback path can be estimated as long as the probe signal is activated. In an embodiment, the probe signal is activated for a predefined period of time. In an embodiment, the probe signal is disabled at the end of said predefined period of time. In an alternative embodiment, the probe signal is disabled (stopped) if/when it is concluded that the ear mould is correctly mounted (as determined by the feedback difference measure, e.g. in that $FBDM=FBE_{LT}-FBE_{CUR}>FBDM_{TH-OK}$ [dB]). In an embodiment, $FBDM_{TH-OK}=-1$ [dB].

In an embodiment, during a power-up procedure, the probe signal (and (special) current feedback path estimation) is activated with a predetermined delay relative to the power-up of the device or subject to predefined criteria, e.g. concerning the occurrence of howl (to allow a certain period for the user to adjust the device in the ear, before the (special) feedback path estimate is initiated).

In an embodiment, during a power-up procedure, the probe signal (and (special) current feedback path estimation) is activated with a predetermined frequency (e.g. every 5 s or every 10 s) as long as the estimate of the current feedback path fulfills a predefined criterion indicating that the ear mould of the listening device is NOT properly mounted in the ear canal of the user. In an embodiment, the predefined criterion is that the feedback difference measure is smaller than a threshold value, e.g. in that $FBDM<FBDM_{TH-NOK}$). In an embodiment a predefined criterion is that $FBDM<<FBDM_{TH-NOK}$, e.g. $FBDM<FBDM_{TH-NOK}-6$ dB or $FBDM<FBDM_{TH-NOK}-12$ dB. In an embodiment, $FBDM_{TH-NOK}\leq-1$ [dB], e.g. equal to −1 or −2 or −3 [dB]. Such criterion may e.g. be fulfilled when the listening device is located on the surface of a desk or held in a hand (of the user), where the attenuation between speaker and microphone of the listening device is small (so that $FB_{CUR}>>FB_{LT}$). In an embodiment, the probe signal is disabled, when it is concluded that the ear mould of the listening device IS properly mounted in the ear canal of the user (e.g. in that the predefined criterion that $FBDM<FBDM_{TH-NOK}$ is no longer fulfilled and/or in that the criterion $FBDM>FBDM_{TH-OK}$ is fulfilled) or after a predefined activation time $T_{act}$ of the probe signal (timeout). In an embodiment, the predefined activation time $T_{act}$ is in the range from 15 s to 300 s, e.g. in the range from 30 s to 60 s.

In an embodiment, the method comprises detection of howl in a signal of the forward path. In an embodiment, howl detection is active before the probe signal generator is activated.

A listening device may—after having been powered off—be powered up before or after being positioned in the ear canal of the user. In case it is mounted before being powered up, it may be properly located when powered up. In an embodiment, the probe signal is only activated if a howl is detected within a predefined time $T_{howl}$ from the start of the power-up procedure. In an embodiment, the predefined time $T_{howl}$ is smaller than 300 s, e.g. smaller than 100 s, e.g. smaller than 30 s. In an embodiment, $T_{howl}$ is larger than 15 s.

In an embodiment, the probe signal is only activated and the estimation of the (special) current feedback path is only started when NO howl has been detected for a predefined time $T_{no-howl}$ (possibly indicating that the listening device is located in the ear canal and a user's hand is removed from the location of the device). In an embodiment $T_{no-howl}$ is larger than 5 s, e.g. in the range from 10 s to 20 s. In an embodiment, $T_{no-howl}$ is smaller than 10 s. In an embodiment, the probe signal (and current feedback estimation) is only activated if a howl has been detected within $T_{howl}$ after startup AND if no howl has been detected within $T_{no-howl}$ after the last howl has been detected.

In general, the larger (more positive) feedback difference measure FBDM, the better. In an embodiment, a detection that $FBDM>>FBDM_{TH}$, e.g. $>>FBDM_{TH-OK}$, is taken to indicate that a new ear mould with improved fitting has been inserted in the user's ear canal. In an embodiment, $FBDM>>FBDM_{TH}$ is taken to mean that $FBDM>FBDM_{TH-OK}+6$ dB or $>FBDM_{TH-OK}+12$ dB. In an embodiment, such detection has to be repeated a number of times, e.g. at least three times, and/or confirmed by a similar result from a contra-lateral listening device of a binaural listening system, before the mentioned conclusion is drawn.

In an embodiment, where a binaural listening system comprising left and right listening devices adapted to communicate with each other, including to exchange information and/or control signals, the probe signal is only activated in a particular one of the left and right listening devices, when or if a valid communication link to the other listening device has been established.

In an embodiment, the first and second listening devices of a binaural listening system are adapted to be synchronized in that the feedback difference measure is determined simultaneously, i.e. based on a simultaneous activation of the probe signal generator to simultaneously play the (same) probe signal and estimate the current feedback path in both listening devices (to ensure that the estimates relate to the same acoustic situation).

In an embodiment, a conclusion is drawn concerning the fitting of a mould at a given point in time based on feedback difference measures in the first and second listening devices originating from different points in time (i.e. based on an activation of the probe signal generator to play the (same) probe signal and estimate the current feedback path in the two listening devices at different points in time).

In an embodiment, a map of conclusions to be drawn from combinations of different values (or ranges of values) of first and second feedback difference measures as measured at the same and/or at different points in time is stored in the first and second listening devices (to ensure a common basis for conclusion in the two instruments).

In an embodiment, the level(s) and/or duration(s) of the probe signal (e.g. of one or more of the tones of the probe signal) is/are adapted to a measured level (or variance) of the input signal of the frequency channel(s) wherein the probe signal (e.g. tone(s)) in question is/are located (and possibly to the level(s) and/or duration(s) of the input signal in one or more neighbouring channels) to ensure that a frequency component (e.g. a tone) of the probe signal is detectable in the feedback signal by the feedback estimation unit. In an embodiment, where the probe signal comprises one or more tones, the order in which the tones are played when activating the probe signal depends on the level of the input signal of the frequency channel(s) wherein the probe signal tone(s) in question is/are located. In an embodiment, the tone(s) of the probe signal are played in an order that reflects increasing level of the input signal (i.e. in the order of decreasing signal to noise ratio (SNR), where the tone represents the signal). In an embodiment, a list of tones of the probe signal and a time dependent scheme for playing the tones is generated (or exists), a particular tone is chosen from the list at a given point in time, if it corresponds to the lowest input level of the input signal at that point in time, and so on until all tones have been played once (preferably without repeating a given tone before all tones of the probe signal have been played). This has the advantage of improving the feedback path estimate, because the SNR of the probe signal tones is optimized (compared to a level independent procedure). In an embodiment, the level estimator is implemented as a 1st order IIR filter. In an embodiment, the time constant of the IIR filter is of the same order as the duration of the tones of the probe signal.

In an embodiment, the variance of the current feedback path estimate is determined in the listening device using a particular probe signal. If a relatively high variance of the current feedback path estimate is measured, a smaller variance can be achieved by 1) increasing the level of the probe signal and/or by 2) increasing the duration of the probe signal (i.e. the time over which the feedback measurement is performed) and thus reduce the uncertainty of the measurement (due to background noise). In an embodiment, the level and/or the duration of the probe signal is adaptively controlled in dependence of the variance of the feedback path estimate. In an embodiment, the adaptation rate of the feedback algorithm is adaptively controlled in dependence of the variance of the feedback path estimate. Alternatively, a large initial adaptation rate is used to get quick initial convergence and subsequently the adaptation rate is decreased to decrease the variance of the estimate in the end.

In an embodiment, where no long term feedback path estimates are stored in a memory of the listening device, the probe signal is activated for a predefined time (e.g. in connection with a power-up procedure or at a user's request and/or after a new ear mould has been taken into use) and the probe signal is adapted to comprise a predefined set of tones, e.g. distributed over the frequency range of operation of the listening device (possibly limited to the frequency range where feedback is normally expected) and a feedback path estimate is determined and stored in the memory of the listening device as a provisional long term feedback path estimate. Alternatively or additionally, instead of only tones, the probe signal may be adapted to comprise a broadband signal, e.g. comprising white noise. Preferably, the listening device is correctly mounted in the ear canal of the user, before initiating the determination of the provisional long term feedback path estimate.

In an embodiment, the current and/or long term feedback path estimate is based on a closed loop estimation based on external and/or internally generated sounds.

In an embodiment, probe signal comprises an input signal picked up by an input transducer of the listening device and is used to determine a current feedback path. In an embodiment, a signal wirelessly received from an auxiliary device (e.g. from an external microphone or an audio delivery device, e.g. an audio gateway, a music player and/or a telephone) is used in the listening device as probe signal to determine a current feedback path. This has the advantage that no feedback howl occurs during the feedback measurement, because a microphone of the listening device may be muted or its input signal attenuated to focus attention on the wirelessly received audio signal.

In an embodiment, the probe signal comprises masked noise (adapted to be inaudible based on a model of the human auditory system, e.g. customized to the particular user). In an embodiment, the probe signal comprises masked noise and selected tones (e.g. at the same time or in different time periods, depending on the mode of operation (e.g. active program) of the listening device).

In an embodiment, the long term feedback path estimate is determined based on values of the current feedback path estimate stored in a memory of the listening device. In an embodiment, the long term feedback path estimate is determined by calculating an average of current feedback path estimates during normal operation of the listening device and storing such average values in a non-volatile memory of the listening device.

In an embodiment, the long term feedback path estimate is determined from a continuously determined (instant) feedback path estimate with a first update frequency $f_{u1}$ and the current feedback path estimate is determined with a second update frequency $f_{u2}$, wherein the first update frequency is smaller than the second update frequency.

In an embodiment, the values of the current feedback path estimate that are used in the determination of the long term feedback path estimate are selected according to a predefined criterion with a view to its reliability. The aim of this selection is to filter out values of the current feedback path estimate that reflect unstable situations (e.g. sudden changes to the feedback path, e.g. due to temporary modifications of the acoustic environment around the listening device, e.g. due to a telephone being brought close to the ear, or the like). Various measures to improve the validity of the long term feedback path estimate is dealt with in our co-pending European patent application EP12150097.9 entitled A method of improving a long term feedback path estimate in a listening device and filed on 3 Jan. 2012, and which is hereby incorporated by reference.

In an embodiment, the current feedback estimate is determined from an instant feedback estimate by down-sampling and/or qualification of the instant feedback path estimate according to its reliability. In an embodiment, the long term feedback path estimate is determined from a number of consecutive current feedback path estimates, e.g. according to an update algorithm.

In an embodiment, the long term feedback path estimate is averaged over a first averaging time $t_{avg1}$ and the current feedback path estimate is averaged over a second averaging time $t_{avg2}$, wherein the first averaging time is larger than the second averaging time.

In an embodiment, the long term feedback path estimate is based on an average of values of current feedback path estimates. In an embodiment, the average estimates are moving averages (i.e. averages over a moving time window of fixed width, e.g. implemented by an FIR filter). In an embodiment, the current feedback estimates are down-sampled (instant) feedback estimates from a feedback estimation unit. In an embodiment, the average estimates are weighted averages, e.g. where the oldest values have smaller weighting factors than the newest values (e.g. implemented by a $1^{st}$ order IIR filter). In an embodiment, the long term feedback path estimate is based on an update algorithm. In an embodiment, the update algorithm only requires the storage of one previous value of the long term feedback measure (e.g. the just preceding value).

In an embodiment, the feedback path is determined at different frequencies f as the ratio of the magnitude of the input signal IN(f) to the magnitude of the output signal OUT(f) of the forward path of the listening device, where the output signal is the probe signal (cf. e.g. circuit in FIG. 3*a*, only converted to the frequency domain, and possibly exclusive of the feedback compensation circuitry). Preferably, a compensation for the delay of the feedback path is performed before the ratio is determined (e.g. by maximizing a cross correlation between signals OUT and IN (signals u and y in FIG. 3*a*) or by storing a sequence of the output signal corresponding to the delay of the feedback path (e.g. 100 ms) and using the relevant values of the signals |IN(f)|/|OUT(d,f)|, where d is the delay.

In an embodiment, the method comprises the step of providing an alarm indication, if the feedback difference measure fulfils a predefined criterion, e.g. exceeds a predefined threshold. This has the advantage of providing a user or another person than the user with an indication of the current fitting of an ear mould of a listening device in the ear canal of the user. 'Another person than the user', can e.g. be a parent of a child or a caring person for the person wearing the listening device. The alarm indication may be provided in a number of ways and according to a number of different criteria, cf. e.g. FIG. 11 and the corresponding description.

In an embodiment, the current feedback path estimate is used to detect whether the ear mould has been replaced, and to subsequently update the long term feedback path estimate.

A Listening Device:

In an aspect, a listening device comprising an ear mould adapted for being mounted in the ear of a user, the listening device comprising a forward path between an input transducer converting an input sound to an electric input signal and a an output transducer for converting an electric output signal to a stimulus perceived by the user as an output sound, the forward path comprising a signal processing unit for applying a frequency dependent gain to the electric input signal or a signal originating therefrom and for providing a processed signal, and feeding the processed signal or a signal originating therefrom to the output transducer;

an analysis path for analysing a signal of the forward path and comprising a feedback estimation unit for estimating a feedback path from the output transducer to the input transducer is furthermore provided by the present application. The listening device further comprises a feedback management unit for a) providing a long term estimate of the feedback path;

b) providing an estimate of the current feedback path;

c) comparing the long term feedback path estimate with the current feedback path estimate, and providing a measure for their difference.

It is intended that the process features of the method described above, in the 'detailed description of embodiments' and in the claims can be combined with the device, when appropriately substituted by a corresponding structural feature and vice versa. Embodiments of the device have the same advantages as the corresponding method.

In an embodiment, the feedback management unit comprises a memory wherein estimated or measured values of the long term feedback path $FBE_{LT}$ at a given frequency f, $FBE_{LT}(f)$, are or can be stored (and possibly updated).

Preferably, the feedback management unit comprises a memory for storing a number of consecutive values of said current feedback path estimates $FBE_{CUR}(f,t)$ at different points in time (e.g. for logging purposes or for averaging purposes, e.g. for use in the determination of long term feedback path estimates) and said long term feedback path estimate. Alternatively or additionally, the feedback management unit is adapted to execute an algorithm for updating the long term estimates (e.g. $FBE_{LT}(f,t)$) based on the current estimates (e.g. $FBE_{CUR}(f,t)$) of the feedback path.

In an embodiment, the listening device comprises a probe signal generator for applying a probe signal to the output signal of the listening device. In an embodiment, the listening device comprises a combination unit allowing to apply the probe signal to the output signal played via the output transducer (e.g. a loudspeaker) either alone or in combination with the processed output signal from the signal processing unit (or not at all). In an embodiment, the probe signal generator is adapted to provide that the probe signal comprises a number of tones. In an embodiment, the probe signal comprises one or more tones $f_1, f_2, \ldots, f_{NT}$ located at one or more of the feedback calculation frequencies $f_1, f_2, \ldots, f_{NT}$, where the current feedback path is estimated. In an embodiment, one or more of the tone frequencies $f_1, f_2, \ldots, f_{NT}$ is/are specifically selected to represent frequencies where feedback is the more likely to occur, In an embodiment, the listening device comprises a band pass filter adapted for filtering the electric input signal—when the electric input signal comprises the probe signal—to allow only frequencies around the frequencies of the probe signal to pass (e.g. tone frequencies $f_1, f_2, \ldots, f_{NT}$). This has the advantage that only the frequency ranges where a contribution from the probe signal can be present are considered (during an estimation of current feedback based on the probe signal). In an embodiment, the listening device comprises a matched filter adapted to identify probe signal components in the input signal (picked up by a microphone), cf. e.g. EP2071873A1.

In an embodiment, the listening device comprises a user interface, e.g. an activation element (e.g. a button or selection wheel) in/on the listening device or in/on a remote control, that allows a user to influence the operation of the listening device and/or otherwise provide a user input, e.g. adapted for allowing a user to initiate that the probe signal is applied (e.g. in a particular mode of operation of the listening device) to the output signal (or is played alone) or to indicate that a mould has been modified, etc. In an embodiment, the user interface comprises an activation element that allows a user to influence the operation of the listening device and/or otherwise provide a user input without using a button. In an embodiment, the activation element comprises a movement sensor, e.g. an acceleration sensor. In an embodiment, a user input can be provided by moving the listening device in a predefined manner, e.g. fast movement, e.g. from a first position to a second position and back to the first position. In an embodiment, a number of different user inputs are defined by a number of different movement patterns. In an embodiment, the user inputs comprises information relating to the fitting of the mould, e.g. about a change of the mould, e.g. to a mould with an improved fitting.

In an embodiment, the listening device may be adapted to provide that the probe signal is comprised in the output signal as part of a start-up procedure and/or when a specific mode or program is activated in the listening device.

In an embodiment, the listening device comprises an alarm indication unit for providing an alarm indication, if the feedback difference measure fulfils a predefined criterion, e.g. exceeds a predefined threshold or lies in a predefined range.

In an embodiment, the listening device comprises one or more alarm signal generators for generating an alarm indication controlled by a signal representative of the measure of the feedback deviation (long term vs. current). In an embodiment, the alarm indication comprises an alarm or a warning or a piece of information. In an embodiment, the alarm signal generators are adapted to issue an acoustic, a visual or a mechanical (vibration) signal (or a mixture thereof). In an embodiment, an alarm or warning signal is issued in case the signal representative of the measure of the feedback deviation exceeds a predefined threshold (indicating that the mould is NOT correctly mounted or less than optimally mounted).

In an embodiment, an information signal is issued in case the signal representative of the measure of the feedback deviation is below a predefined threshold (indicating that the mould IS correctly mounted). In an embodiment, the listening device comprises a transmitter and is adapted for wirelessly transmitting the alarm indication signal (possibly depending on its kind) to another device (e.g. an audio gateway, a remote control, a smart phone, a baby alarm device, or the like), e.g. to a monitoring system, e.g. via a network. This has the advantage that a caring person may be informed about the status of the mounting of a listening device, e.g. a hearing instrument, worn by a user, even if the caring person is NOT at the same location as the user of the listening device. In an embodiment, the listening device comprises an interface to a network, e.g. comprising an IP-address, e.g. allowing the listening device to send information, including alarm or other information signals to another device via the network, e.g. the Internet.

In an embodiment, the listening device is adapted to provide that the alarm indication indicates a degree of fitting of the ear mould, e.g. dynamically indicating an improved fitting or a worsened fitting. In an embodiment, the listening device is adapted to provide that a degree of fitting of the ear mould is dynamically indicated by the listening device or by another device in communication with the listening device. This may e.g. be indicated by a change of level and/or frequency of a sound or a change of blinking frequency of a light signal. The alarm indication may be provided by the listening device or by another device in communication with the listening device. In an embodiment, a representation of the feedback difference measure is presented (e.g. graphically) on a display of an auxiliary device (e.g. a remote control of the listening device)

In an embodiment, the listening device is adapted to provide a frequency dependent gain to compensate for a hearing loss of a user. In an embodiment, the listening device comprises a signal processing unit for enhancing the input signals and providing a processed output signal. Various aspects of digital hearing aids are described in [Schaub; 2008].

In an embodiment, the listening device comprises an antenna and transceiver circuitry for wirelessly receiving a direct electric input signal from another device, e.g. a communication device or another listening device. In an embodiment, the listening device comprises a (possibly standardized) electric interface (e.g. in the form of a connector, e.g. to an FM-shoe) for receiving a wired direct electric input signal from another device, e.g. a communication device or another listening device. In an embodiment, the listening device comprises an antenna and transceiver circuitry for wirelessly transmitting a signal to another device e.g. another listening device or an auxiliary device. In an embodiment, the listening device is adapted to transmit an information signal and/or a control signal and/or an audio signal to the other device. In an embodiment, the listening device is adapted to transmit a feedback path estimate and or a feedback difference measure to the other device.

In an embodiment, the listening device is a portable device, e.g. a device comprising a local energy source, e.g. a battery, e.g. a rechargeable battery.

The listening device comprises a forward or signal path between an input transducer (microphone system and/or direct electric input (e.g. a wireless receiver)) and a loudspeaker. In an embodiment, the input transducer comprises two or more microphones. In an embodiment, the listening device comprises an analysis path comprising functional components for analyzing the input signal (e.g. determining a level, a modulation, a type of signal, an acoustic feedback path estimate, etc.). In an embodiment, the feedback estimation unit comprises a common feedback estimation system for all microphones of the input transducer of the listening device. In an embodiment, the feedback estimation unit comprises a feedback estimation system for each microphone of the input transducer of the listening device (allowing each feedback path to be separately estimated). In an embodiment, some or all signal processing of the analysis path and/or the signal path is conducted in the frequency domain (cf. e.g. FIG. 5). In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 audio data samples. Other frame lengths may be used depending on the practical application.

In an embodiment, the listening devices comprise an analogue-to-digital (AD) converter to digitize an analogue input with a predefined sampling rate, e.g. 20 kHz. In an embodiment, the listening devices comprise a digital-to-analogue (DA) converter to convert a digital signal to an analogue output signal, e.g. for being presented to a user via an output transducer.

In an embodiment, the listening device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the listening device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the listening device is split into a number NI of frequency bands, where NI is e.g. larger than 5, such as larger than 10, such as larger than 50, such as larger than 100, such as larger than 500, at least some of which are processed individually. In an embodiment, the listening device is/are adapted to process a signal of the forward and/or analysis path in a number NP of different frequency channels (NP≤NI). The frequency channels may be uniform or non-uniform in width (e.g. increasing in width with frequency), overlapping or non-overlapping (cf. e.g. FIG. 6).

In an embodiment, the listening device comprises one or more detectors for classifying an acoustic environment around the listening device and/or for characterizing the signal of the forward path of the listening device. Examples of such detectors are a level detector, a speech detector, a feedback detector (e.g. a tone or howl detector, an autocorrelation detector, etc.), a directionality detector, etc. In an embodiment, one or more of such detectors are used in the determination of the current and/or long term feedback path estimate(s). An autocorrelation estimator is e.g. described in US 2009/028367 A1. A howl detector is e.g. described in EP 1 718 110 A1.

In an embodiment, the listening device comprises an acoustic (and/or mechanical) feedback suppression system. Adaptive feedback cancellation has the ability to track feedback path changes over time. It is typically based on a linear time invariant filter to estimate the feedback path but its filter weights are updated over time [Engebretson, 1993]. The filter update may be calculated using stochastic gradient algorithms, including some form of the popular Least Mean Square (LMS) or the Normalized LMS (NLMS) algorithms. They both have the property to minimize the error signal in the mean square sense with the NLMS additionally normalizing the filter update with respect to the squared Euclidean norm of some reference signal. Other adaptive algorithms may be used, e.g. RLS (Recursive Least Squares). Various aspects of adaptive filters are e.g. described in [Haykin].

In an embodiment, the listening device further comprises other relevant functionality for the application in question, e.g. compression, noise reduction, etc.

In an embodiment, the output transducer for converting the electric output signal to a stimulus perceived by the user as an output sound comprises a vibrator of a bone conducting hearing aid device. In an embodiment, the output transducer comprises a receiver (loudspeaker) for providing the stimulus as an acoustic signal to the user.

In an embodiment, the listening device comprises a hearing aid, e.g. a hearing instrument, in particular a hearing instrument comprising a part adapted for being located at the ear or fully or partially in the ear canal of a user (e.g. a deep in the ear canal type hearing instrument), a headset, an earphone, an ear protection device or a combination thereof.

Use:

In an aspect, use of a listening device as described above, in the 'detailed description of embodiments' and in the claims, is moreover provided. In an embodiment, use is provided in a system comprising audio distribution, e.g. a system comprising a microphone and a loudspeaker in sufficiently close proximity of each other to cause feedback from the loudspeaker to the microphone during operation by a user. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Listening System:

In a further aspect, a listening system comprising a listening device as described above, in the 'detailed description of embodiments', and in the claims, AND an auxiliary device is moreover provided.

In an embodiment, the system is adapted to establish a, preferably wireless communication link between the listening device and the auxiliary device to provide that information (e.g. control and status signals (e.g. including information about an estimated feedback path, e.g. a current feedback estimate, e.g. a feedback difference measure), possibly audio signals) can be exchanged or forwarded from one to the other. In an embodiment, the feedback path estimates and/or feedback difference measures are stored and/or further processed in the auxiliary device.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the listening device. In an embodiment, the auxiliary device is or comprises a remote control for controlling functionality and operation of the listening device(s).

In an embodiment, the auxiliary device is another listening device.

In an embodiment, the listening system comprises two listening devices adapted to implement a binaural listening system, e.g. a binaural hearing aid system.

In an embodiment, the alarm indication concerning the degree of fitting of the ear mould of a listening device of the system is provided in the auxiliary device, e.g. via a display on the auxiliary device (e.g. a remote control or an audio gateway device or a mobile telephone apparatus, e.g. a smart phone).

In an embodiment, the auxiliary device comprises a probe signal generator for applying a probe signal to the output signal of the listening device(s). Thereby a probe signal for use in estimating the current feedback path can be forwarded from the auxiliary device to the listening device, e.g. simultaneously to first and second listening devices of a binaural listening system.

In an embodiment, the probe signal generator for applying a probe signal to the output signal of the listening device(s) is controllable from the auxiliary device, e.g. via a user interface on the auxiliary device (or alternatively or additionally via an activation element on the listening device(s)). In an embodiment, the probe signal is transmitted to the listening device(s) via the communication link between the listening device(s) and the auxiliary device and played through the output transducer (e.g. loudspeaker(s)) of the listening device(s).

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Acoustic feedback occurs because the output loudspeaker signal from an audio system providing amplification of a signal picked up by a microphone is partly returned to the microphone via an acoustic coupling through the air or other media. A particular problem occurs in listening devices to children, because the ears of children grow fast and thus coupling conditions (leakage) changes over time. Another problem occurs for people who need help to properly mount a mould of a listening device in the ear canal. A similar but slightly different problem occurs in connection with listening devices adapted for being located deep in the ear canal of a user, e.g. wholly or partially in the bony part of the ear canal. For such small devices the correct mounting (and the verification of a correct mounting) in the ear canal may pose difficulties.

Figure 1A:
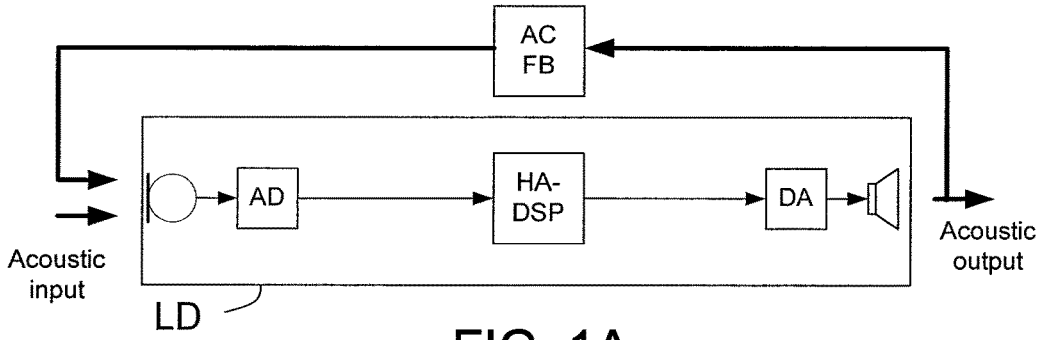
FIGS. 1A, 1B, 1C, 1D, 1E, 1F, and 1G show four embodiments of prior art listening devices (FIG. 1A, 1B, 1C, 1D), and an embodiment of a listening device (FIG. 1E) and a binaural listening system (FIG. 1F) and a binaural listening system comprising a remote control device (FIG. 1G) according to the present disclosure.

FIG. 1*a*-1*d* show four embodiments of a prior art listening device (LD), where an external (acoustic) feedback path (AC FB) is indicated in each embodiment. FIG. 1*a* shows a simple hearing aid comprising a forward or signal path from an input transducer (microphone) to an output transducer (loudspeaker), the forward path being defined there between and comprising analogue-to-digital (AD) and digital-to-analogue (DA) converters, and a processing unit (HA-DSP) for applying a (time and) frequency dependent gain to the signal picked up by the microphone and providing an enhanced signal to the loudspeaker. An analysis filter bank may be inserted in the forward path (e.g. after the AD-converter) to provide signals in the time-frequency domain, each signal being represented by time dependent values in a number of frequency bands. A synthesis filter bank (S-FB) may in such case correspondingly be inserted in the forward path, e.g. after the signal processing unit (HA-DSP) to provide the output signal to the loudspeaker in the time domain. Processing in the frequency domain may be applied in (other) selected parts of the listening device depending on the application (algorithm) in question, e.g. in an analysis path, e.g. fully or partially comprising a feedback cancellation system, cf. e.g. FIG. 5.

Figure 1B:
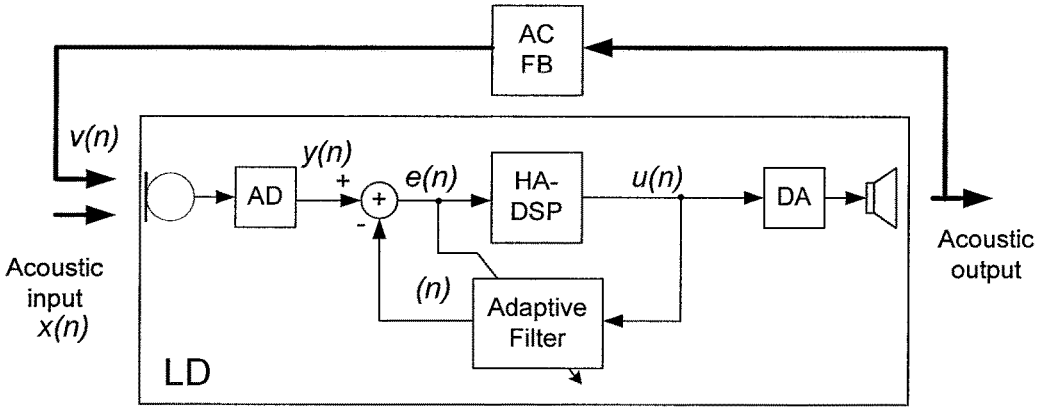
Figure 1C:
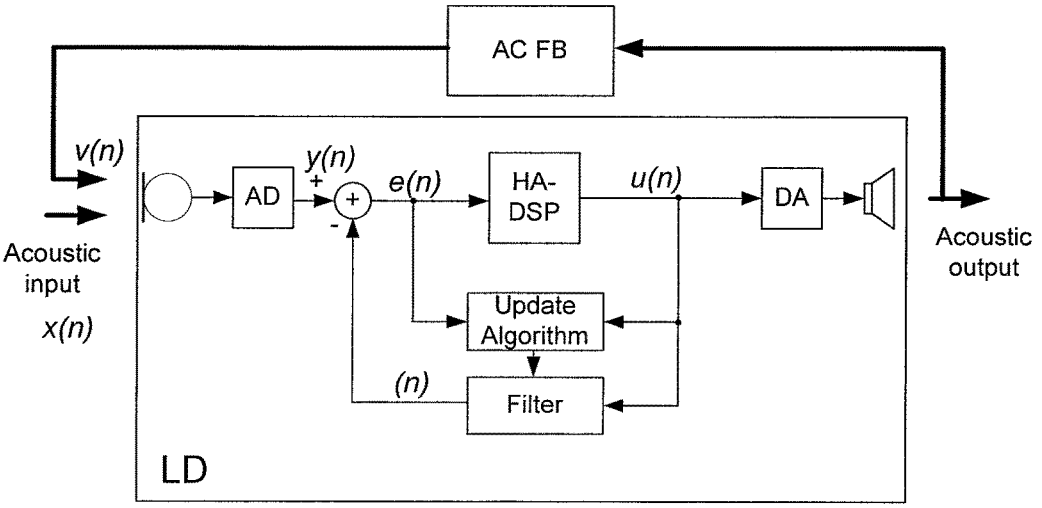
Figure 1D:
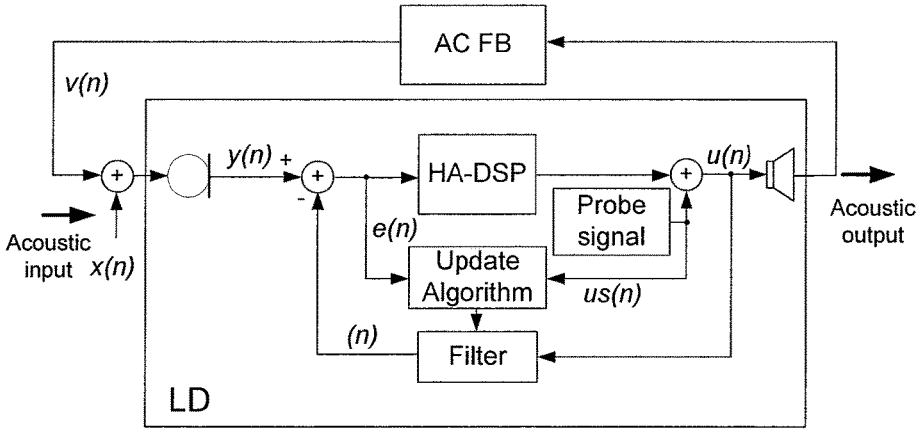

The embodiments shown in FIGS. 1*b*, 1*c* and 1*d* each comprise the same basic elements as discussed for the embodiment of FIG. 1*a* and additionally a feedback cancellation system. Hearing aid feedback cancellation systems (for reducing or cancelling acoustic feedback from the 'external' feedback path (AC FB) may comprise an adaptive filter (Adaptive filter in FIG. 1*b*, Update Algorithm and Filter in FIG. 1*c*, 1*d*), which is controlled by a prediction error algorithm, e.g. an LMS (Least Means Squared) algorithm, in order to predict and cancel the part of the microphone signal that is caused by feedback (from the loudspeaker to the microphone of the listening device). FIGS. 1*b*, 1*c* and 1*d* illustrate examples of this. The adaptive filter (in FIGS. 1*c* and 1*d* comprising a variable Filter part and a prediction error or Update Algorithm part) is (here) aimed at providing a good estimate of the 'external' feedback path from the input to the digital-to-analogue (DA) converter to the output of the analogue-to-digital (AD) converter. The prediction error algorithm uses a reference signal (e.g. the output signal u(n) in FIGS. 1*b* and 1*c* or a probe signal us(n) in FIG. 1*d* (or a mixture thereof)) together with a signal e(n) originating from the microphone signal y(n) to find the setting of the adaptive filter that minimizes the prediction error, when the reference signal is applied to the adaptive filter. The microphone signal y(n) is a mixture of a target signal (Acoustic input, x(n)) and a feedback signal (v(n)). The forward path of the listening devices (LD) of FIGS. 1*b*, 1*c* and 1*d* also comprises a signal processing unit (HA-DSP), which e.g. is adapted to adjust the signal to the impaired hearing of a user (by applying a time and frequency dependent gain to the input signal, which intends to compensate the user's hearing impairment). The estimate v□(n) of the feedback path v(n) provided by the adaptive filter is (in FIGS. 1*b*, 1*c* and 1*d*) subtracted from the microphone signal y(n) in sum unit '+' providing a so-called 'error signal' e(n) (or feedback-corrected signal), which is fed to the processing unit HA-DSP and to the algorithm part of the adaptive filter. To provide an improved decorrelation between the output (u(n)) and input (y(n)) signals, it may be desirable to add a probe signal to the output signal. This probe signal us(n) can be used as the reference signal to the algorithm part (Update Algorithm) of the adaptive filter, as shown in FIG. 1*d* (output us(n) of block Probe signal in FIG. 1*d*), and/or it may be mixed with the ordinary output of the signal processing unit to form the reference signal.

Figure 1E:
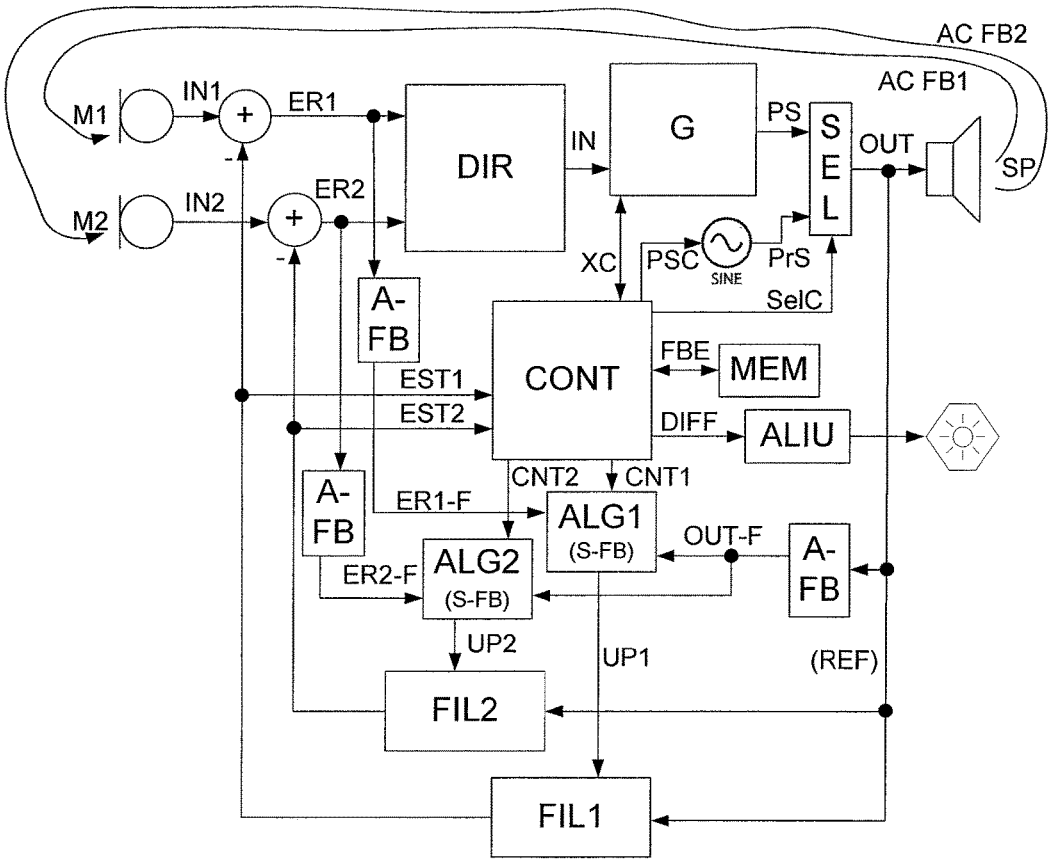

FIG. 1*e* shows an embodiment of a listening device according to the present disclosure. The input transducer of the listening device comprises two microphones (M1, M2), each microphone having a separate feedback path (AC FB1 and AC FB2, respectively) from the output transducer (speaker SP) of the listening system. Hence, each feedback path is separately estimated by the feedback estimation unit. Alternatively, only the resulting signal, after a directional algorithm has been applied to the microphone signals, is feedback compensated. The feedback estimation unit comprises two adaptive filters (ALG1, FIL1 and ALG2, FIL2, respectively) each for estimating their respective feedback path AC FB1 and AC FB2. The respective feedback path estimates EST1, EST2 are subtracted from the corresponding input signals IN1, IN2 in respective summation units ('+') to provide corresponding feedback corrected (error) signals ER1, ER2, which are fed to the DIR unit comprising a directional algorithm providing a resulting directional (or omni-directional) signal IN to the gain block G. The error signals ER1, ER2 are additionally fed to algorithm parts ALG1, ALG2 for determining the filter coefficients for the adaptive filters that minimize the prediction error of signals ER1, ER2, respectively, when the reference signal (output signal OUT) is applied to the respective variable filter parts (FIL1, FIL2) of the adaptive filters. In the present embodiment of a listening device, the determination of update filter coefficients (signals UP1, UP2) in the algorithm parts ALG1, ALG2 is performed in the frequency domain. Hence, analysis filter banks A-FB are inserted in the error and reference (REF) signal input paths to convert time domain error signals ER1, ER2 and output signal OUT to the frequency domain (providing signals ER1-F, ER2-F and OUT-F), and corresponding synthesis filter banks (indicated by '(S-FB)') form part of the algorithm parts ALG1, ALG2 to provide the update filter coefficients UP1, UP2 to the variable filter parts FIL1, FIL2 in the time domain. This has the advantage of minimizing delay in the feedback estimation. The listening device further comprises a control unit CONT for analysing the current feedback path estimates EST1, EST2 of the feedback paths AC FB1 and AC FB2, respectively, for determining a feedback difference measure (FBDM) from the current (or instant) feedback path estimates EST1, EST2 and a long term feedback path estimate stored in memory MEM, and for controlling the probe signal generator (here exemplified as tone generator SINE). In an embodiment, the control unit CONT is adapted for comparing the feedback estimates from the first and second feedback estimation units. In an embodiment, one of the two or an average of the two feedback path estimates is used to define the current feedback path estimate, which is used to determine the feedback difference measure. In an embodiment, both feedback estimates are used to define individual current feedback path estimates and individual long term feedback path estimates are used to determine individual feedback difference measures FBDM1 and FBDM2. In an embodiment, the current feedback estimate(s) is/are not considered reliable and will not be stored as a reliable value of the current feedback estimate, if the difference (FBDM1-FBDM2) between the feedback estimates is larger than a predefined threshold value. The listening device further comprises an alarm indication unit (ALIU) for indicating a status of the current degree of fitting of the ear mould based on the feedback difference measure FBDM via control signal DIFF from the control unit CONT. The control unit CONT may further be adapted to control the two adaptive filters (e.g. a step size of their adaptation algorithms), cf. control signals CNT1 and CNT2 to algorithm parts ALG1, ALG2. The control unit CONT is further in communication with the signal processing unit G via signal XC to possibly update the values of IGmax used to determine an appropriate gain for a user of the listening device. The IGmax values may be extracted from the current and/or long term feedback path estimates stored in the memory MEM, which are accessible to the control unit CONT via signal FBE. The processed output signal PS from the gain block G is fed to a selector unit SEL. The output OUT of the selector unit SEL is fed to output transducer SP and to variable filter parts FIL1, FIL2 of the two adaptive filters of the feedback estimation unit. The listening device further comprises a probe signal generator (Probe signal in FIG. 1*d*), here a SINE generator for generating a number of sine tones (signal PrS) which are fed to selector unit SEL (and used to estimate the instant feedback path). The output OUT of the selector unit SEL is controlled by signal SelC from the control unit CONT and may contain the probe signal PrS or the processed output signal PS (or a mixture thereof). The activation of the SINE generator, the number NT and frequencies $f_i$ of the tones $f_1$, $f_2$, . . . , $f_{NT}$ are controlled by the control unit CONT via signal PSC. The activation of the probe signal comprising NT tones may be performed according to a predefined scheme as part of a power-up procedure and/or at a request of a user or another person, via a user interface, e.g. a remote control (cf. e.g. FIG. 1*g*).

Figure 1F:
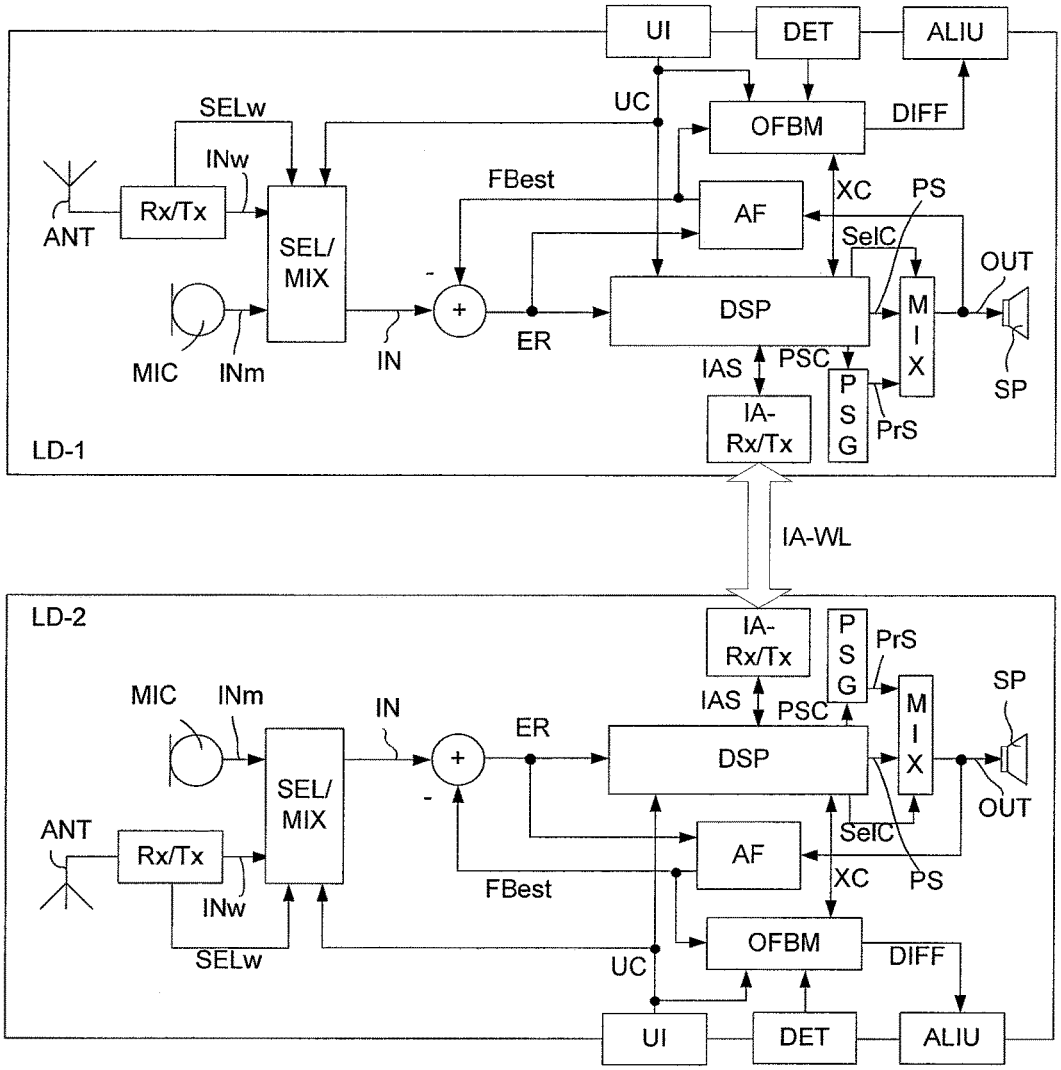

FIG. 1*f* shows an embodiment of a binaural listening system (e.g. a binaural hearing aid system) according to the present disclosure. The binaural hearing aid system comprises first and second hearing listening devices (LD-1, LD-2, e.g. hearing instruments) adapted for being located at or in left and right ears of a user. The listening devices are adapted for exchanging information between them via a wireless communication link, e.g. a specific inter-aural (IA) wireless link (IA-WL). The two listening device (LD-1, LD-2) are adapted to allow the exchange of status signals, e.g. including the transmission of a feedback difference measure FBDM determined by a device at a particular ear to the device at the other ear (via signal IAS). To establish the inter-aural link, each listening device comprises antenna and transceiver circuitry (here indicated by block IA-Rx/Tx). Each listening device comprises a forward signal path comprising a microphone (MIC) a signal processing unit (DSP) and a speaker (SP) and a feedback cancellation system comprising a feedback cancellation unit comprising adaptive filter (AF) and combination unit ('+') for subtracting the estimate of the feedback path FBest provided by the adaptive filter (AF) from the input signal IN and thereby providing feedback corrected (error) signal ER, as described in connection with FIG. 1*b*-1*e*. Each listening device further comprises an online feedback manager (OFBM) for determining a feedback difference measure FBDM indicative of the difference between the currently estimated feedback path and a typical (undisturbed, long term) feedback path. In the binaural hearing aid system of FIG. 1*f*, a signal IAS comprising feedback difference measure FBDM generated by the online feedback manager (OFBM) and—via signal XC—exchanged with the signal processing unit (DSP) of one of the listening devices (e.g. LD-1) is transmitted to the other listening device (e.g. LD-2) and/or vice versa. The feedback difference measure FBDM from the local and the opposite device are compared and in some cases used together to decide whether an ear mould of the device in question is correctly mounted or whether a substantial change to fitting of the ear mould has occurred (be it 1) a decreased fitting, possibly indicating incorrect mounting and/or growth of the ear channel or 2) an improved fitting, possibly indicating that a new ear mould (with improved fitting) has been taken into use). The interaural signals IAS may further comprise information that enhances system quality to a user, e.g. improve signal processing, and/or values of detectors (DET) that may be of use in the other listening device. The interaural signals IAS may in addition to the feedback difference measure e.g. comprise directional information or information relating to a classification of the current acoustic environment of the user wearing the listening devices, etc. In an embodiment, detector values (e.g. autocorrelation) from both listening devices are compared in a given listening device. In an embodiment, a value of a given detector is only used in the criterion for reliability of the feedback path estimate, if the two detector values from the left and right listening devices deviate less than a predefined absolute or relative amount. Each of the listening devices further comprises an alarm indication unit (ALIU) for indicating a status of the current degree of fitting of the ear mould based on the feedback difference measure FBDM via signal DIFF from the OFBM-unit.

The listening devices (LD-1, LD-2) each further comprise a probe signal generator (PSG) for generating a probe signal adapted to be used in an estimation of the feedback path from the speaker (SP) to the microphone (MIC). The activation and control of the probe signal generator PSG is performed by the signal processing unit (DSP) via signal PSC. It may, alternatively or additionally be controllable via a user interface (UI) on the listening device and/or via an auxiliary device, e.g. a remoted control device (see e.g. FIG. 1*g*). The forward path further comprises a mixer/selector unit (MIX) for mixing or selecting between inputs PrS (probe signal) and PS (processed signal from the signal processing unit). The mixer/selector unit (MIX) is controlled by the signal processing unit (DSP) via signal SelC. The control of the mixer/selector unit (MIX) may e.g. be influenced via the user interface (UI) and control signal UC, and/or via an auxiliary device, e.g. a remote control device.

In an embodiment, the listening devices (LD-1, LD-2) each comprise wireless transceivers (ANT, Rx/Tx) for receiving a wireless signal (e.g. comprising an audio signal and/or control signals) from an auxiliary device, e.g. an audio gateway device and/or a remote control device. The listening devices each comprise a selector/mixer unit (SEL/MIX) for selecting either of the input audio signal INm from the microphone or the input signal INw from the wireless receiver unit (ANT, Rx/Tx) or a mixture thereof, providing as an output a resulting input signal IN. In an embodiment, the selector/mixer unit can be controlled by the user via the user interface (UI), cf. control signal UC and/or via the wirelessly received input signal (such input signal e.g. comprising a corresponding control signal or a mixture of audio and control signals). In the embodiment of FIG. 1*f*, an extraction of a selector/mixer control signal SELw is performed in the wireless receiver unit (ANT, Rx/Tx) and fed to the selector/mixer unit (SEL/MIX).

Figure 1G:
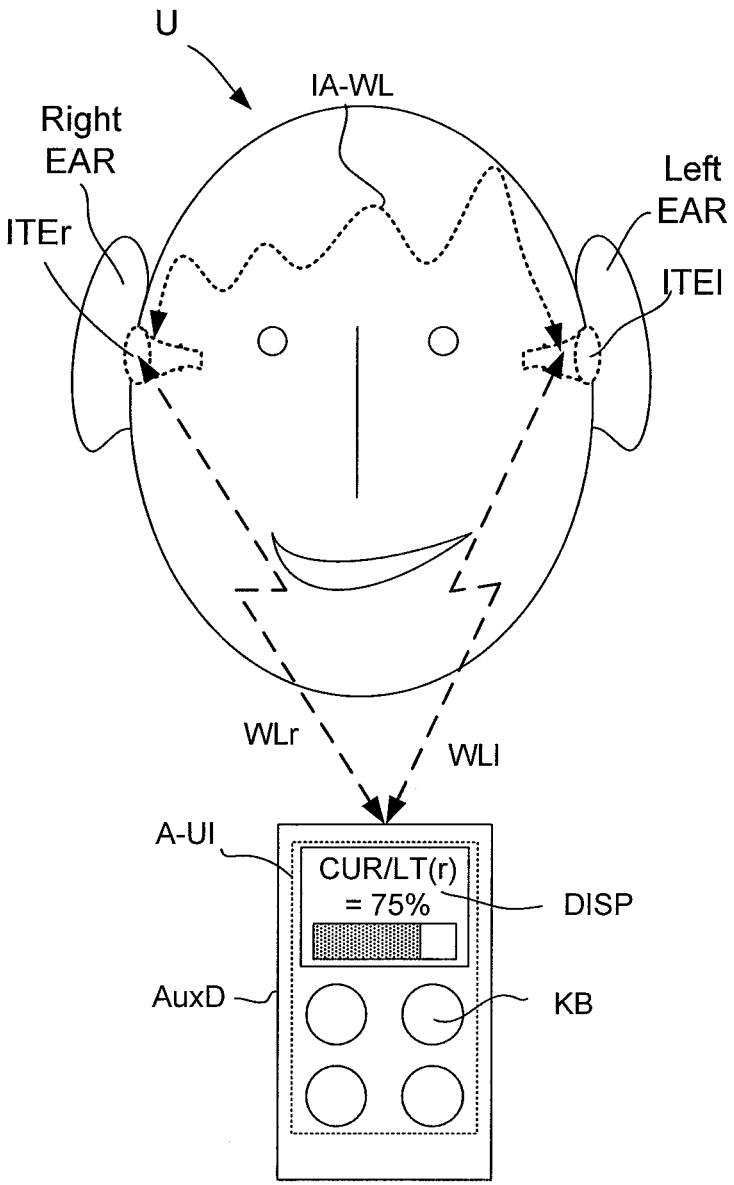

FIG. 1*g* shows a binaural listening system according to the present disclosure comprising right and left listening devices and an auxiliary device (AuxD) in the form of a remote control device for controlling the listening devices. The right and left listening devices comprise ITE-parts (ITEr and ITEl, respectively) adapted for being mounted in the right and left ears (Right EAR, Left EAR in FIG. 1*g*) of a user (U). The listening devices and the remote control device are adapted to establish wireless links (IA-WL, WLr, WLl) between them allowing the exchange of information between the devices. The right and left listening devices of the embodiment of a binaural listening system of FIG. 1*g* are listening devices according to the present disclosure as e.g. exemplified in FIGS. 1*e*, and 1*f*. The feedback difference measures FBDM (or a signal derived therefrom) determined in each listening device (ITEr, ITEl) are transmitted via the respective links (WLr, WLl) to the remote control device (AuxD) for (here graphical) presentation on a display (DISP) of the remote control device (cf. e.g. bar graph denoted CUR/LT(r)=75% indicating that the ratio of current to long term feedback path estimates is 0.75 for the right listening device ITEr). The binaural listening system is further adapted to allow an initiation of the estimation of the current feedback path (by activating the probe signal generator) via the user interface (A-UI) of the remote control device, e.g. a keyboard (KB). Thereby simultaneous estimates of the current feedback path are provided (to ensure that the estimates relate to the same acoustic situation). Such feedback-path-estimate-initiating command may be transmitted from the remote control device to the listening devices via respective wireless links (WLr, WLl), possibly supplied by the interaural link (IA-WL) between the two listening devices.

A fast and reliable method to estimate a gain margin may be used to determine if an ear mould has been correctly mounted. The problem is illustrated in FIG. 2. Such a feature can be used by a parent who is not sure whether the child's ear mould is correctly mounted, or similarly at nursery homes where e.g. elderly people may need assistance in order to insert an ear mould correctly. In the case of a child, the long term feedback path estimate is preferably updated during the child's growth. In the case of an adult, e.g. elderly person, the long term feedback path estimate need not be updated and can e.g. be determined 'once and for all' by measurement in a fitting session. The degree of fitting of the ear mould may e.g. be indicated via a sound signal indication and/or an indication by light (e.g. a diode).

Figure 2A:
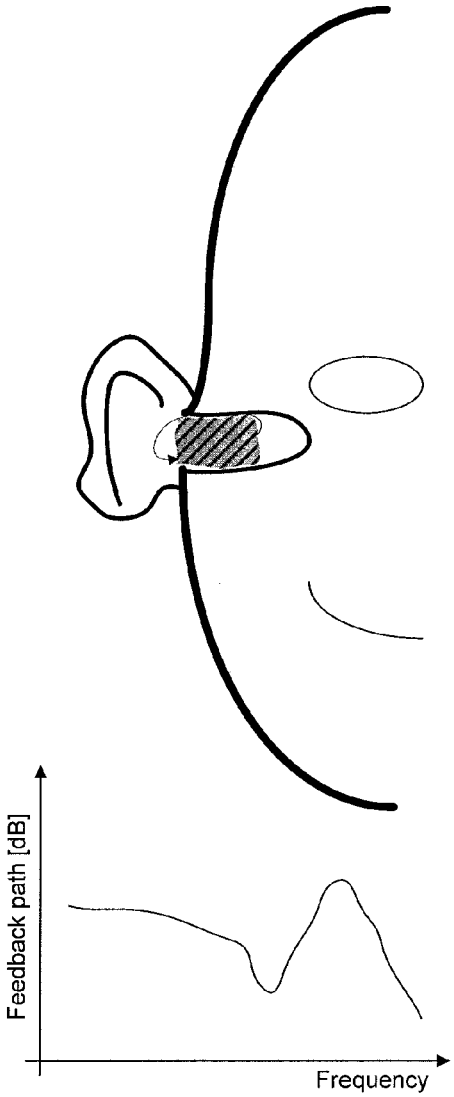
FIGS. 2A and 2B illustrate two examples of an ear mould of a listening device when mounted in an ear canal of a user and corresponding frequency dependent feedback.
Figure 2B:
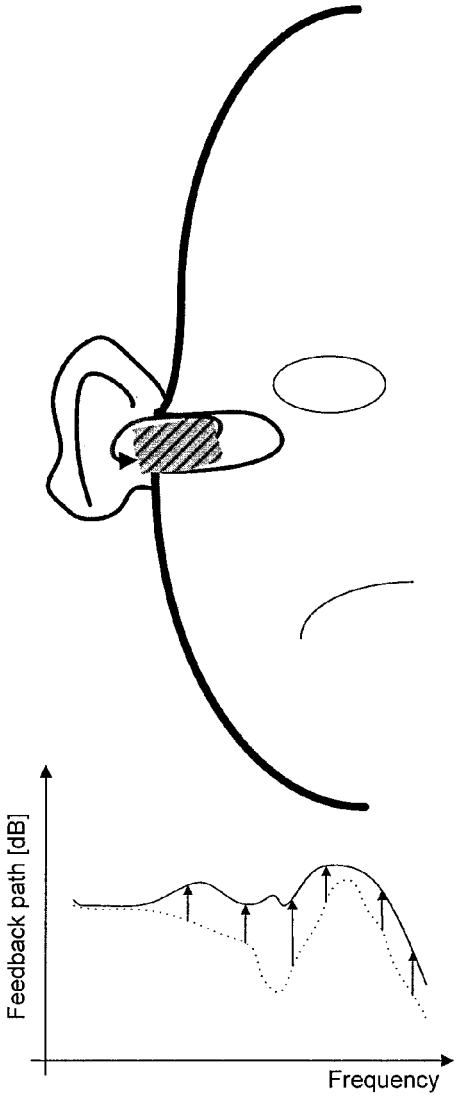

FIG. 2 illustrates two examples of an ear mould of a listening device when mounted in an ear canal of a user, the ear mould comprising a loudspeaker for generating a sound into the volume between the mould and the ear drum of said ear canal. FIG. 2*a* illustrates (top) a situation where the ear mould is relatively tightly fit to the walls of the ear canal, and (bottom) a corresponding frequency dependent feedback. FIG. 2*b* illustrates (top) a situation where the ear mould is less tightly fit to the walls of the ear canal, thereby allowing a leakage of sound from said volume to the environment, and (bottom) a corresponding frequency dependent feedback, the increased feedback being indicated by the arrows at different frequencies.

When an ear mould has not been correctly mounted (right), the feedback path (bold arrow from loudspeaker to environment) deviates from the 'optimal' feedback path (left, thin arrow). If a reliable (current) feedback path estimate can be determined within a short duration of time, the estimate may be compared to a long term estimate, and if the deviation is too high, a warning should appear telling that the ear mould is incorrectly mounted. The example is shown for an ITE (in the ear) device, but it is also relevant for other hearing aid styles, e.g. a BTE (behind the ear) hearing aid style.

Figure 3A:
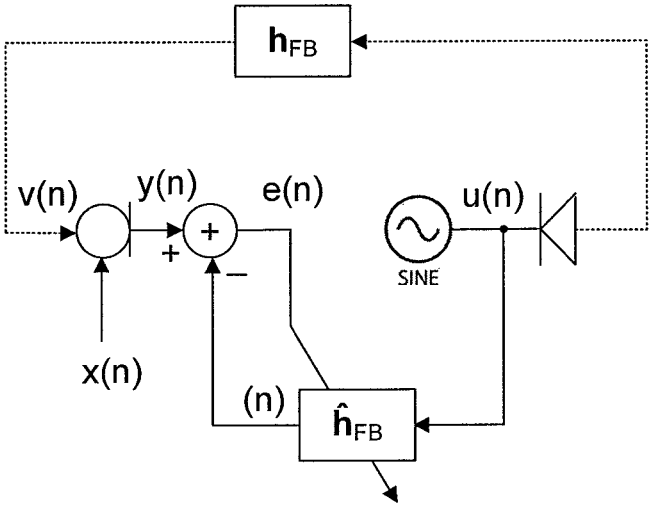
FIGS. 3A and 3B show two variants of a model for open loop feedback path estimation using a probe signal (e.g. one or more sine tones), where the adaptive filter $\hat{H}_{FB}$ is estimated from signals u(n) and e(n)
Figure 3B:
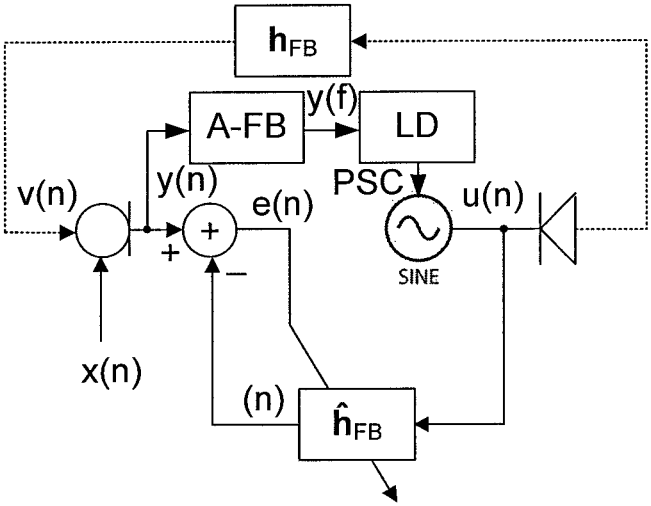

FIG. 3 shows a model for open loop feedback path estimation using a sine tone, where the adaptive filter $h\square_{FB}$ is estimated from signals u(n) and e(n), where n is a time index related to a sampling rate ($f_s$) of the system ($\Delta n/f_s$ defining a time range). A (fast) feedback path estimate can e.g. be obtained by playing a number of tones (e.g. a melody) at different frequencies (open loop feedback estimation). The listening device comprises (in a special open loop mode) a tone generator (SINE in FIG. 3*a*, 3*b*) for feeding a signal comprising the tone or tones to the loudspeaker (instead of the normal output signal from the signal processing unit (HA-DSP in FIG. 1, not shown in FIG. 3*a*, 3*b*). The listening device is adapted to switch the output signal u(n) to the tone generator in a particular mode of the listening device (e.g. as part of a start-up procedure, or at the request of a user, e.g. via a user interface, e.g. a remote control). This is particularly relevant for verifying an appropriate mounting of an ITE-part of a listening device for a (e.g. elderly) person needing assistance in such mounting, or for a deep in the ear canal type of listening device, where a proper mounting is difficult to verify for any person. The tones may be played one at a time or a few tones simultaneously, if the tones are well separated in frequency (e.g. more than 1 kHz apart). The tones are propagated along the feedback path and enter the microphone as feedback signal v(n) (possibly mixed with a (target) signal x(n) from the environment) and arrive in the listening device as electric input signal y(n). The feedback estimation filter $h\square_{FB}$ can then—by minimizing error signal e(n)—rapidly adapt to the correct feedback path estimate value for the given frequencies (represented by the probe signal). These values may then be compared to a long term estimate of the feedback path stored in a memory of the listening device. The stored long term estimate may be slowly varying (updated over time) to comply with changes in the ear canal of the user (e.g. a child's growth). Alternatively, stored long term estimate may be fixed, in cases where no substantial changes to the dimensions of the ear canal of the user are expected (e.g. for adult (e.g. elderly) people needing help to mount their listening device(s) by a caring person). If the values deviate too much (e.g. if the feedback deviation ($\Delta FB = FBE_{LT} - FBE_{CUR}$) is smaller than a predefined value, e.g. based on a sum of the deviations, $\Sigma[\Delta FB(f_T)]$, being smaller than a sum threshold value $\Delta_{\Sigma}FB_{THR}$, where the sum ($\Sigma$) is over the tones $f_T$ comprised in the probe signal), the ear mould is not correctly inserted, and a warning should inform a user (or observer) accordingly. The warning signal may comprise an acoustic, a visual or a mechanical (vibration) signal (or a mixture thereof) and the listening device may comprise corresponding signal generators controlled by a signal representative of the feedback deviation. The melody should loop (i.e. persist) for a certain predefined amount of time, or until it is detected that the mould of the listening device has been correctly mounted. In an embodiment, an information signal is issued after a user-initiated or after an automatically initiated measurement of current feedback based on a probe signal comprising a selected number of tones, in case it is concluded that the mould IS correctly mounted. The two embodiments shown in FIGS. 3*a* and 3*b* are nearly identical. The embodiment shown in FIG. 3*b* additionally comprises a level detector LD for providing a level of the input signal y(f) at different frequencies f. This is used as a control input PSC to the probe signal generator (here tone generator SINE) to adapt the level of the tones (or at least some of the tones) of the probe signal generator to the level of the input signal at the corresponding frequencies f. Alternatively or additionally, the duration of one or more tones may be adapted to the level of the input signal, e.g. by increasing the duration with increasing level. The listening device of FIG. 3*b* hence comprises an analysis filter bank A-FB for converting the time domain input signal y(n) to a frequency domain input signal y(f).

Figure 4A:
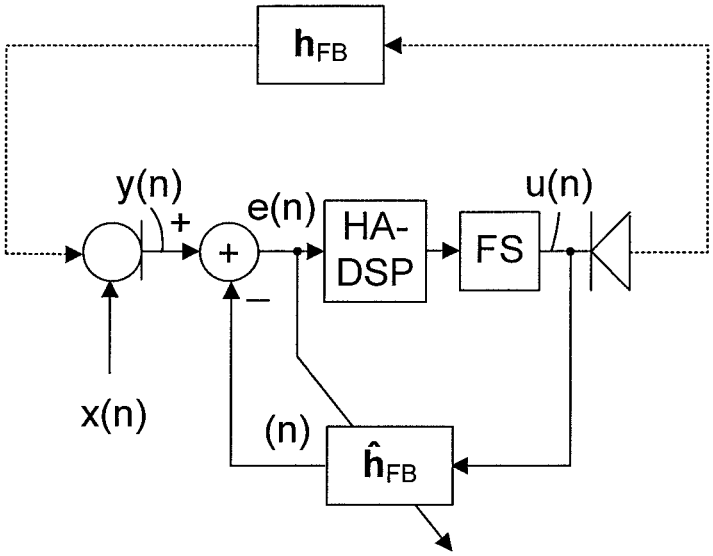
FIGS. 4A and 4B show two variants of a model for closed-loop feedback path estimation, one using frequency shift of the processed output signal (FIG. 4A), and one using the addition of a probe signal to the processed output signal (FIG. 4B)
Figure 4B:
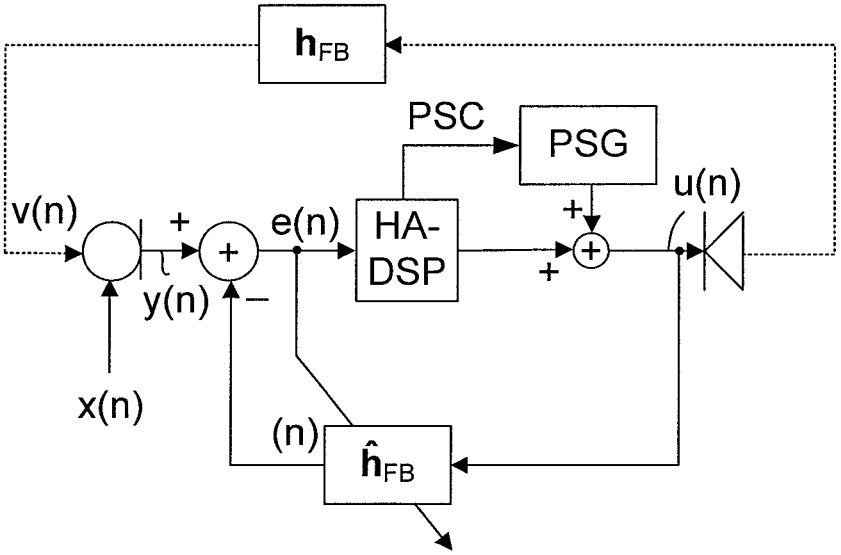

Alternatively, the feedback estimation can be done using closed loop estimation. FIG. 4 shows a model for closed-loop feedback path estimation using frequency shift (FIG. 4*a*) and using the addition of a probe signal without frequency shift (FIG. 4*b*). In the embodiments of a listening device shown in FIG. 4, HA-DSP represents the forward path gain and FS is a frequency shift block for applying a (preferably inaudible) frequency shift to the output signal (cf. e.g. [Joson et al., 1993]). PSG is a probe signal generator for providing a probe signal (see e.g. WO 2009/007245 A1), which is added to the output signal from the processing unit HA-DSP to decrease correlation between input and output signal of the forward path of the listening device. A decrease in correlation may be achieved by any relevant measure, including frequency dependent delay, phase or frequency modification, etc. (here frequency shift is used). The probe signal generator PSG (including its activation) is controlled by the signal processing unit HA-DSP via control signal PSC. The feedback path $h_{FB}$ is estimated by the feedback estimation unit (adaptive filter) $h\square_{FB}$ based on the frequency shifted output signal u(n) (FIG. 4*a*) and the output signal u(n) comprising a probe signal (FIG. 4*b*), respectively.

In the estimation model shown in FIG. 4*a* the feedback estimation relies on external sounds x(n) that are combined with the feedback signal v(n) resulting in (electric) microphone signal y(n). In the estimation model shown in FIG. 4*b* a (preferably inaudible) probe signal is added to the output signal (here, no frequency shift is applied when the probe signal is added; alternatively, a frequency shift may applied to the combined output signal). In either case of the closed loop estimation, external sounds x(n) are audible, but the estimation is typically slower than in the open loop estimation of FIG. 3. An advantage of the closed loop estimation is that it can be performed during normal operation of the listening device.

Figure 5:
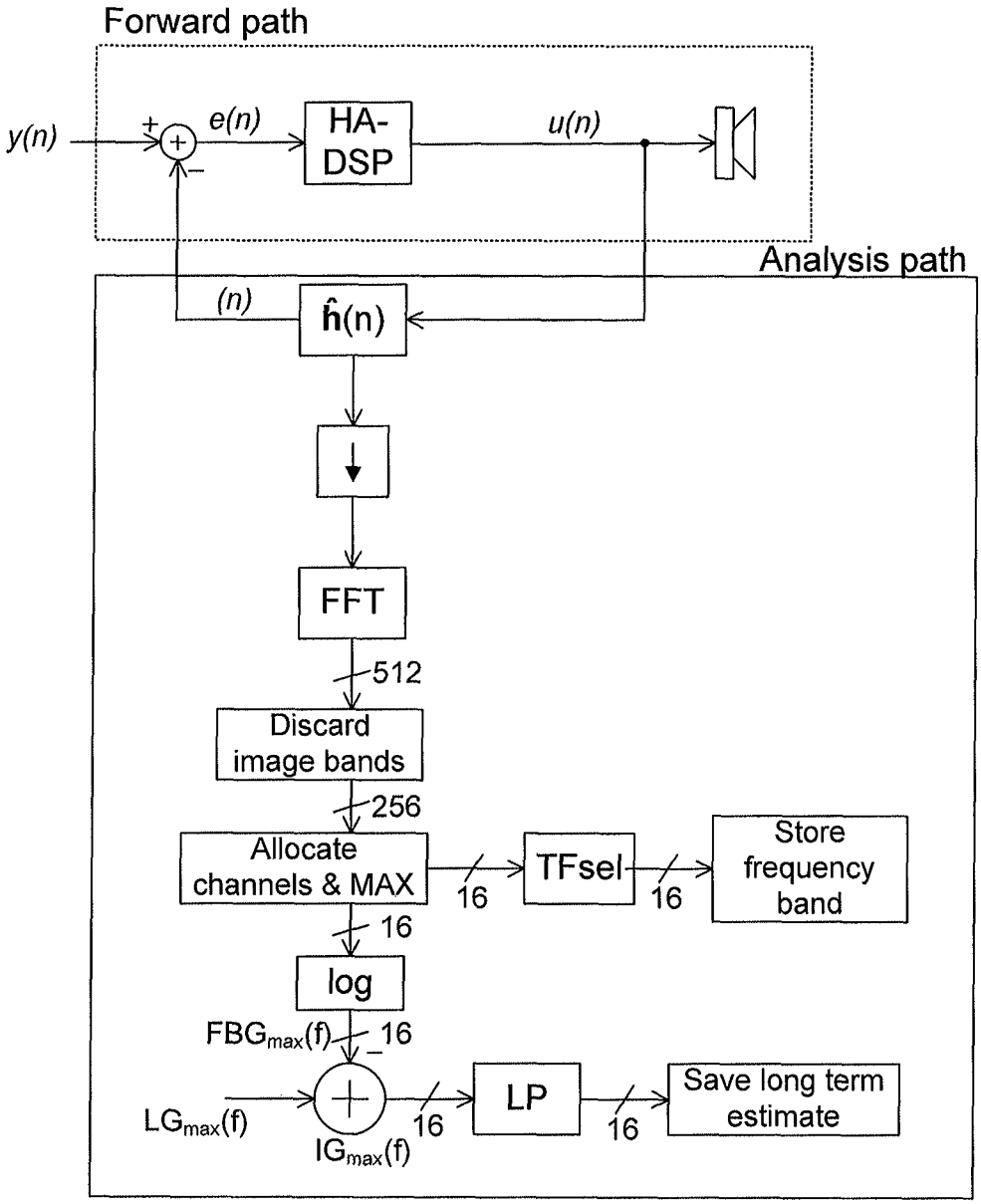
FIG. 5 shows a part of a listening device comprising a Forward path for applying gain to an input signal and an Analysis path for providing a long term estimate of the feedback path.

FIG. 5 shows a part of a listening device comprising a Forward path for applying gain to an input signal and an Analysis path for providing a reliable (current) estimate of the feedback path. The Forward path is indicated by the dotted rectangular enclosure and the Analysis path is indicated by the solid rectangular enclosure. The Forward path comprises sum unit ('+'), signal processing unit HA-DSP and a loudspeaker. The input signals to the sum unit ('+') are an audio signal y(n) picked up by an input transducer, e.g. a microphone, and a feedback path estimate v□(n) from a feedback estimation unit (here unit h□(n)), respectively. The resulting output e(n) of the sum unit (which is an input to the signal processing unit HA-DSP) is a feedback corrected input audio signal. The signal processing unit HA-DSP is adapted to enhance the feedback corrected input audio signal e(n) and to provide a processed output signal u(n) which is fed to the loudspeaker and to the feedback estimation unit h□(n). The signals are indicated in the time domain (time index n). The symbol h□(n) of the feedback estimation filter unit is intended to indicate an impulse response of the nit, and the output signal v□(n) of h□(n) is determined from the input signal u(n) to the unit by a linear convolution of the input signal with the impulse response of the unit (h□(n)). The signal processing in the forward path performed in signal processing unit HA-DSP may be performed fully or partially in the time domain or in the frequency domain and may or may not comprise frequency transposition. The Analysis path comprises adaptive feedback estimation filter h□(n) for repeatedly ('continuously', i.e. with a specific (e.g. variable) update frequency) providing an estimate of the feedback path. The current feedback path estimate is extracted from the feedback path estimation filter h□(n). A frequency domain representation of the feedback path estimate is e.g. obtained by a fast Fourier transform (FFT). This transformation can be carried out for every update of the feedback path estimation filter h□(n) or it can be down-sampled by e.g. only updating the frequency domain representation with a predefined update frequency $f_{ds}$, every $1/f_{ds}$, e.g. every 500 ms. In the embodiment of FIG. 5, the repeatedly generated feedback filter estimate h□(n) is down-sampled or decimated (cf. block '↓') and concerted into the frequency domain, e.g. using a fast Fourier transformation (cf. block FFT), e.g. a 512 point FFT, of the down-sampled or decimated feedback path estimate. The contents of the (512) FFT-bins are symmetric (because the input signal to the FFT-algorithm is real) and only half of them (here 256; actually 255 full bands and 2 half bands, one at each end of the frequency range) are needed to represent the input signal in the frequency domain (hence the '256' on the output of the Discard image bands block indicating the total number of frequency bands constituting the channels). Because the listening device processing is preferably performed in channels that are wider than the FFT bands, the frequency domain bands (here 256) are divided into a number of channels (here 16 channels) (cf. block Allocate channels & MAX, and e.g. FIG. 6, providing a linear to non-linear band mapping), each channel comprising a number of frequency bands (possibly different for different channels, cf. FIG. 6)). Within each channel, the maximum feedback path estimate is extracted (worst case) in a number of selected channels, e.g. in all channels (cf. block Allocate channels & MAX providing MAX(|FBE($FB_{ji}$)|) in each channel, $FB_{ji}$ being the frequency bands constituting channel j, i=1, 2, . . . , Nj, Nj being the number of frequency bands in channel j, cf. FIG. 7). The estimated value of maximum feedback gain (FBG), termed, $FBE_{max}$, may (optionally) be converted into dB (cf. unit log and output value $FBE_{max}(f)$ and converted to (minimum) maximum insertion gain (cf. sum unit '+' and output value $IG_{max}(f)$) in each frequency channel. $IG_{max}(f)$ values for each channel are determined from predetermined values of $LG_{max}(f)$ (LG=IG+FBG and hence IG=LG−FBG). The predefined maximum loop gain values $LG_{max,j}$ may be different from frequency channel to frequency channel. The predefined maximum loop gain $LG_{max,j}$ in a particular frequency channel j is e.g. determined from an estimate of the maximum allowable loop gain before howling occurs ($LG_{howl,j}$) diminished by a predefined safety margin ($LG_{margin,j}$). In an embodiment, the predefined maximum loop gain values $LG_{max,j}$ are determined on an empirical basis, e.g. from a trial and error procedure, e.g. based on a user's typical behaviour (actions, environments, etc.). In an embodiment, the predefined maximum loop gain values are identical for all frequency channels, j=1, 2, . . . , NP. In an embodiment, the predefined maximum loop gain values are smaller than or equal to +12 dB, or +10 dB, or +5 dB, or +2 dB. In an embodiment, the predefined maximum loop gain values are smaller than or equal to 0 dB, such as smaller than or equal to −2 dB, smaller than or equal to −6 dB.

In order to obtain a robust long term estimate of the feedback path, the feedback path estimates $FBE_{max}$ (or corresponding long term estimates of minimum insertion gain $IG_{max}$) in each frequency channel are preferably low-pass filtered (averaged, cf. blocks LP). The changes that are intended to be monitored via feedback path estimates (such as a growing ear of a child) are generally relatively slow (weeks or months) so relatively fast fluctuations are preferably filtered out. The corresponding frequency bands ('FB' or frequency 'f' or corresponding index) are e.g. 'filtered' (cf. block TFsel), e.g. averaged, before being stored. Preferably, the filtering comprises a selection process (e.g. comprising a histogram procedure), wherein the most frequently occurring frequency corresponding to the maximum value of (long term) feedback gain within a given channel is selected. The frequency band ($FB_{CHj}$) corresponding to the maximum value of (long term) feedback gain (or the minimum value of maximum insertion gain $IG_{max}$) for each of the number of selected channels, e.g. in all channels (j=1, 2, NP), is stored in a memory (cf. block Store frequency band). Correspondingly, the maximum value of (long term) feedback gain $FBE_{max}$ (or as here the minimum value of $IG_{max}$) for each of the number of selected channels ($FBE_{max}$ ($FB_{CHj}$)), e.g. for all channels (j=1, 2, . . . , NP), is stored (cf. block Save long term estimate).

Figure 6:
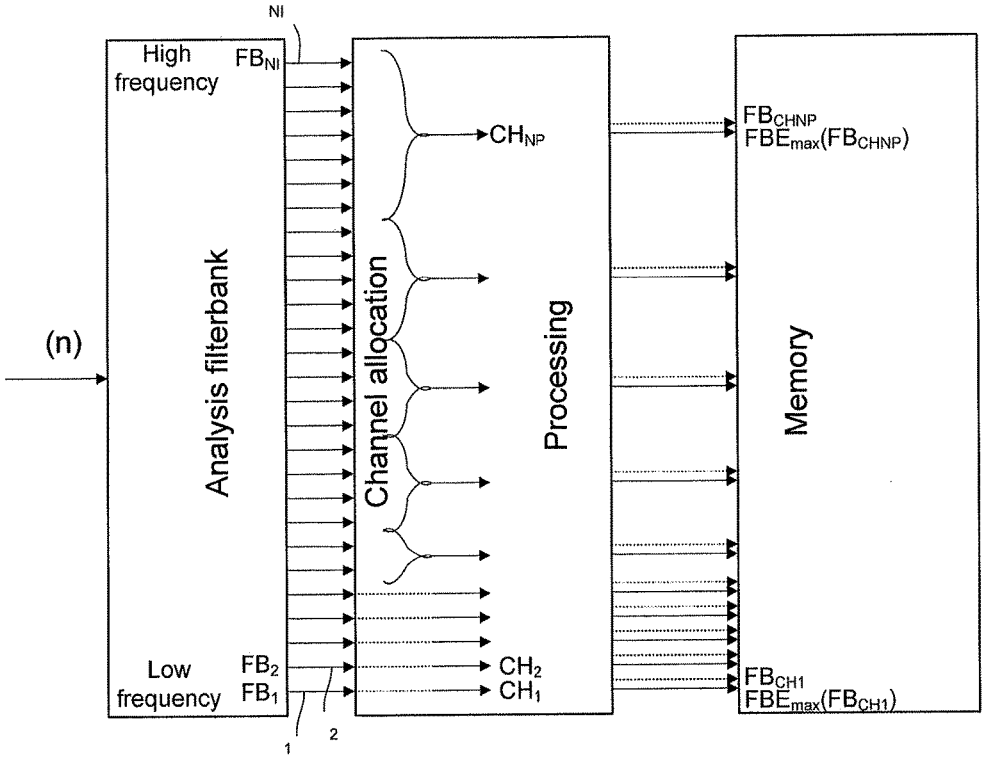
FIG. 6 shows a part of a listening device comprising processing in a number of frequency channels NP based on a time to time-frequency conversion unit providing a larger number of frequency bands NI than channels NP, and where a frequency band allocation unit provides allocation of a number of frequency bands to each of the different frequency channels.

FIG. 6 shows a part of a listening device comprising processing in a number of frequency channels NP based on a time to time-frequency conversion unit providing a larger number of frequency bands NI than channels NP, and where a frequency band allocation unit provides allocation of a number of frequency bands to each of the different frequency channels. The listening device of FIG. 6 comprises an Analysis filterbank (e.g. comprising a DFT algorithm, such as an FFT algorithm) to split a time domain input signal F□(n) (representing a feedback path estimate) into a number NI of frequency band signals $F\square_1$, $F\square_2$, . . . , $F\square_{NI}$, in respective frequency bands $FB_1$, $FB_2$, . . . , $FB_{NI}$, which are fed to a Channel allocation and Processing unit, where the maximum value of the frequency band signals $F\square_{i,j}$ corresponding to a particular channel j is identified (for each channel, j=1, 2, . . . , NP). The resulting values of (current or long term) maximum feedback $FBE_{max}(FB_{CHj})$ and corresponding frequency band $FB_{CHj}$ are stored in a Memory unit for each channel j=1, 2, . . . , NP.

The input audio signal (e.g. received from a microphone system of the listening device or as here from a feedback estimation unit) has its energy content below an upper frequency in the audible frequency range of a human being, e.g. below 20 kHz. The listening device is typically limited to deal with signal components in a subrange [$f_{min}$; $f_{max}$] of the human audible frequency range, e.g. to frequencies below 12 kHz and/or frequencies above 20 Hz. In the Analysis filterbank of FIG. 6, the input frequency band signals $F\square_1$, $F\square_2$, . . . , $F\square_{NI}$, representing values of the input signal F□(n) in the frequency range from $f_{min}$ to $f_{max}$ (represented by frequency bands $FB_1$, $FB_2$, . . . , $FB_{NI}$) considered by the listening device are indicated by arrows from the Analysis filterbank to the Channel allocation and Processing unit. The frequency bands are arranged with increasing frequencies from bottom (Low frequency) to top (High frequency) of the drawing. The Channel allocation unit is adapted to allocate input frequency bands $FB_1$, $FB_2$, . . . , $FB_{NI}$ to a reduced number of processing channels $CH_1$, $CH_2$, . . . , $CH_{NP}$ in a predefined manner (or alternatively dynamically controlled). Each frequency band signal $F\square_1$, $F\square_2$, . . . , $F\square_{NI}$ comprises e.g. a complex number representing a magnitude and phase of the signal (at a particular time instant). In the embodiment of FIG. 6, the 5 lowest input frequency bands are each allocated to their own processing channel, whereas for the higher input frequency bands more than one input frequency band are allocated to the same processing channel. In the exemplary embodiment of FIG. 6, the number of input frequency bands allocated to the same processing channel is increasing with increasing frequency. Any other allocation may be appropriate depending on the application, e.g. depending on the input signal, on the user, on the environment, etc. The signal content $F\square(CH_j)$ of a given processing channel, $CH_j$, at a given time is a function of the signal content signal content $F\square(FB_{ji})$ of the frequency bands (i=1, 2, . . . , Nj), constituting the channel $CH_j$ in question (at that time). In an embodiment, the signal content $F\square(CH_j)$ of channel j is a weighted sum (e.g. an average) of the signal contents $F\square(FB_{ji})$ (i=1, 2, . . . , Nj) of the frequency bands constituting channel j.

Figure 7A:
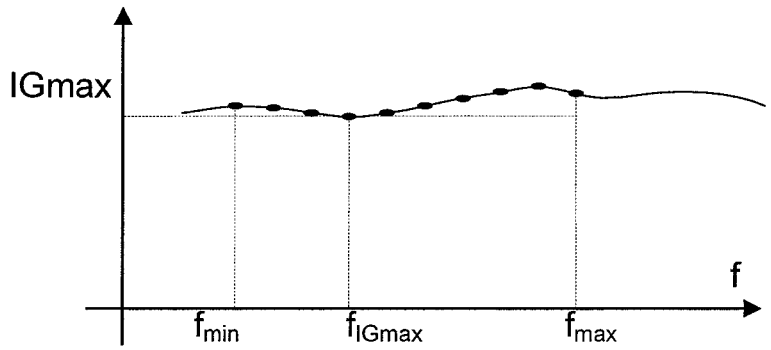
FIGS. 7A and 7B show values of $IG_{max}$ determined at various frequencies from a minimum frequency $f_{min}$ to a maximum frequency $f_{max}$, FIG. 7A representing values in the full frequency range of interest, and FIG. 7B representing values in a specific processing channel j.
Figure 7B:
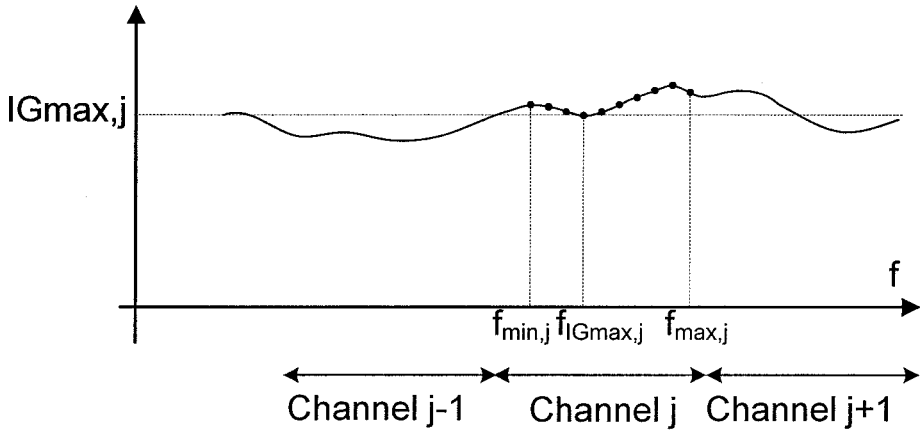

FIG. 7 shows values of IGmax determined at various frequencies from a minimum frequency $f_{min}$ to a maximum frequency $f_{max}$, FIG. 7*a* representing values in the full frequency range of interest, and FIG. 7*b* representing values in a specific processing channel j.

FIG. 7*a* illustrates a situation where $IG_{max}$ values are available at a number of frequencies over the frequency of operation of the listening device between a minimum $f_{min}$ and a maximum $f_{max}$ frequency. In an embodiment a single frequency $f(IG_{max})$ corresponding to the minimum value of $IG_{max}(f)$, $f_{min}<f<f_{max}$, is determined and used in the feedback estimation procedure. Alternatively, a number of the frequencies where $IG_{max}$ is available are selected and used in the feedback estimation procedure, e.g. the ones corresponding to the $N_{IGmax}$ lowest $IG_{max}$-values. In an embodiment, $N_{IGmax}$ is smaller than 10, e.g. in the range from 2 to 6, e.g. 3 or 5. As described in connection with FIGS. 5 and 6, the frequency band $FB_{CHj}$ within each channel (j) that yields the maximum feedback value $FBE_{max,j}$ (or minimum $IG_{max,j}$ as illustrated in FIG. 5, 7) is preferably stored in addition to the long term feedback path estimates $FBE_{max,j}$ for the channel in question. Thereby the tones of a probe signal at frequencies corresponding to said frequency bands $FB_{CHj}$ providing said maximum feedback values $FBE_{max,j}$ can advantageously be used to estimate the current feedback in particular situations, e.g. during start-up or when otherwise needed, e.g. at a user's (or caring person's) request. FIG. 7*b* illustrates a situation where a number of values of $IG_{max}$ at different frequencies (frequency bands, each band comprising a single value corresponding to a single frequency) are available within a frequency channel. The frequency f ($IG_{max,j}$) (=$FB_{CHj}$) corresponding to the minimum value of $IG_{max,j}(f)$, $f_{min,j}<f<f_{max,j}$, is preferably determined and used to select the most relevant tones to play (to provide a fast and reliable feedback path estimate at the selected (important) frequencies). In an embodiment, a frequency $f(IG_{MAX,j})$ is determined for each frequency channel. In an embodiment, the corresponding tones are used in the feedback estimation procedure. Alternatively, a number of the frequencies are selected and used in the feedback estimation procedure, e.g. the ones corresponding to the lowest $IG_{max}$-values, e.g. corresponding to 50% of the channels, e.g. for less than 10 channels, e.g. for 3 or 5 channels.

Figure 8:
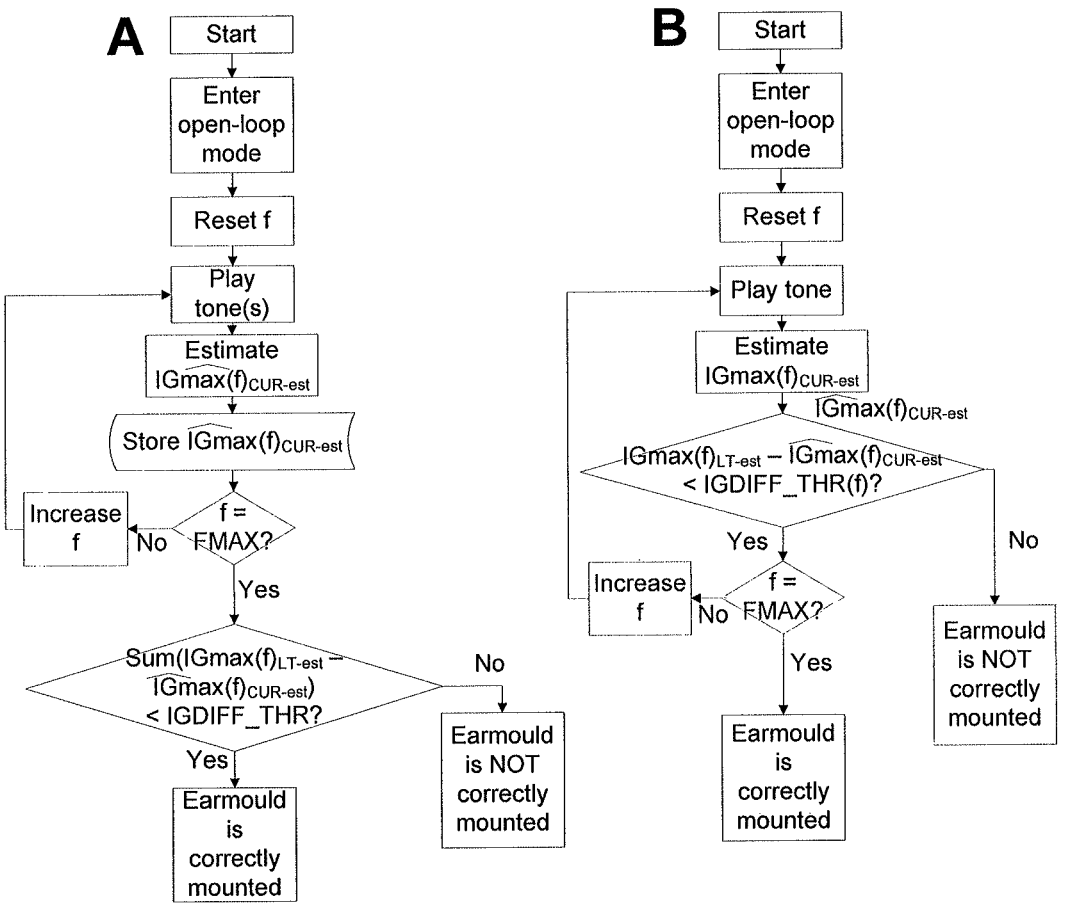
FIG. 8 shows respective flow charts for two embodiments (A and B) of a method of deciding whether or not an ear mould is correctly mounted in an ear canal of a user, the method being based on feedback estimation using a probe signal comprising a number of selected tones.
Figure 9:
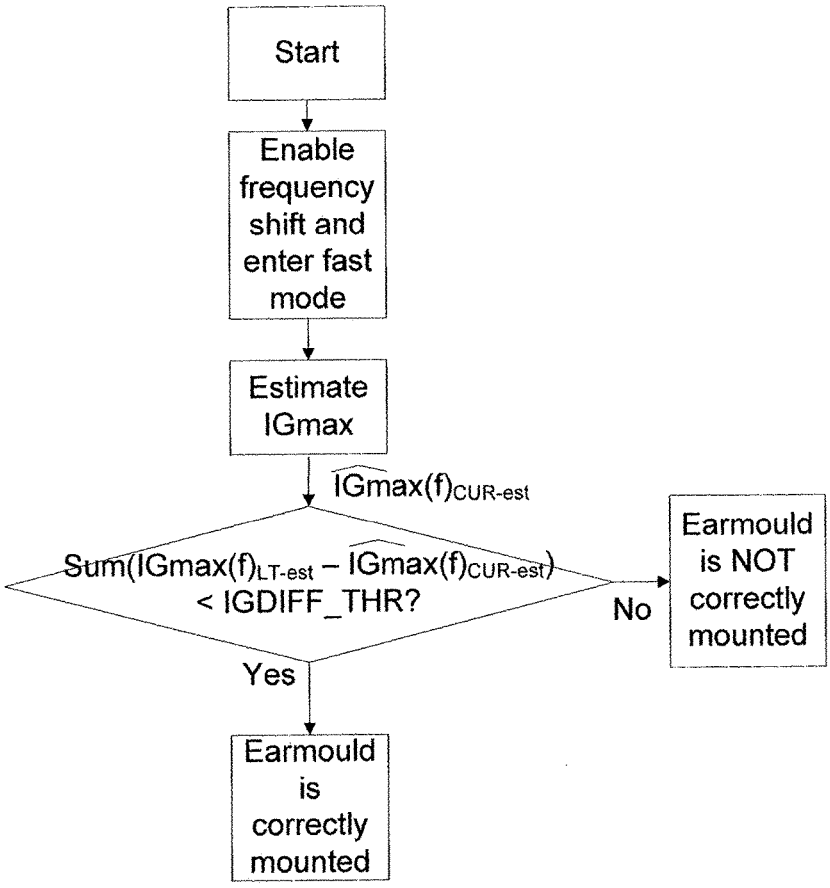
FIG. 9 shows a flow chart for a third embodiment of a method of deciding whether or not an ear mould is correctly mounted in an ear canal of a user, the method being based on feedback estimation using frequency shift of the output signal.

FIG. 8 and FIG. 9 show possible implementations of a detector of a correctly mounted ear mould either by use of tones (FIG. 8) or by use of frequency shifting (FIG. 9). Alternatively or additionally, inaudible probe noise may be inserted in the output signal and used to provide a reliable feedback path estimate (cf. e.g. FIG. 1*d*, 1*f* or FIG. 4*b*). IGmax is typically in dB (but may alternatively be given as a number, a gain). IGmax is inversely proportional to $FBE_{max}$.

FIG. 8 shows respective flow charts for two embodiments (A and B) of a method of deciding whether or not an ear mould of a listening device is correctly mounted in an ear canal of a user, the method being based on feedback estimation using a probe signal comprising a number of selected tones, cf. FIG. 3.

FIG. 8 shows exemplary flowcharts for tone based decision. In order to obtain a fast and robust estimation, no sound passes through the forward path of the listening device (open loop feedback estimation). The initial steps are identical in both embodiments A and B: After entering the open loop feedback estimate mode, a probe signal comprising one or a few tones is played via a loudspeaker of the listening device and the feedback path is estimated. From the feedback estimate, (current) IGmax is derived. This (current) IGmax is compared to stored values of the long term (true) IGmax estimate (as e.g. discussed in connection with FIG. 5).

Embodiment A continues as follows: The (current) IGmax is estimated for all the predefined frequencies (between a minimum and a maximum frequency) and a joint decision is made whether the ear mould is correctly inserted as defined by the criterion: $SUM(IGmax(f)_{LT\text{-}est}-IGmax(f)_{CUR\text{-}est})<IGDIFF_THR$? where $IGmax(f)_{LT\text{-}est}$ and $IGmax(f)_{CUR\text{-}est}$ are the long term and current estimates, respectively, and IGDIFF_THR is a predefined threshold value for the sum of differences. If YES, the ear mould is correctly mounted, if NO, it is not. In case $SUM(IGmax(f)_{LT\text{-}est}-IGMax(f)_{CUR\text{-}est})<<IGDIFF_THR$, indicating that the current IGmax is substantially larger than the long term estimate of IGmax, this may be taken as an indication that a new, better fitting ear mould has been mounted in the user's ear canal. In an embodiment, IGDIFF_THR is frequency dependent. In an embodiment, the feedback difference measure comprises a frequency dependent weighting factor w(f), e.g. SUM(w(f)(IGmax(f)$_{LT\text{-}est}$−IGmax(f)$_{CUR\text{-}est}$))<IGDIFF_THR?

In an embodiment, the criterion is combined with a corresponding criterion in a contra-lateral listening device of a binaural listening system (if both devices agree to a criterion, the conclusion is the more reliable).

Embodiment B continues as follows: The ear mould is assumed to be correctly placed only if current IGmax at each tone frequency is within an acceptable range (i.e. if IGmax at the frequency in question fulfils the criterion: SUM(IGmax(f)$_{LT\text{-}est}$−IGmax(f)$_{CUR\text{-}est}$)<IGDIFF_THR, where IGmax(f)$_{LT\text{-}est}$ and IGmax(f)$_{CUR\text{-}est}$ are the long term and current estimates, and IGDIFF_THR is a predefined threshold value for the 'single frequency difference'. If just a single tone is above the threshold, the ear mould is assumed NOT to be inserted correctly. Corresponding criteria may alternatively be based on feedback path estimates (FBE), e.g. SUM(FBEmax(f)$_{LT}$−FBEmax(f)$_{CUR}$)>FBEDIFF_THR.

FIG. 9 shows a flow chart for a third embodiment of a method of deciding whether or not an ear mould of a listening device is correctly mounted in an ear canal of a user, the method being based on feedback estimation using frequency shift of the output signal. In this embodiment, noise may be present in the input signal (and or added via a probe signal generator), cf. FIG. 4.

After entering the (fast) feedback estimate mode based on frequency shift, the feedback path is estimated. From the feedback estimate, (current) IGmax is derived. This (current) IGmax is compared to stored values of the long term IGmax estimate (as e.g. discussed in connection with FIG. 5). The (current) IGmax is estimated for all the predefined frequencies and a joint decision is made whether the ear mould is correctly inserted as defined by the criterion: SUM(IGmax(f)$_{LT\text{-}est}$−IGmax(f)$_{CUR\text{-}est}$)<IGDIFF_THR? where SUM(IGmax(f)$_{LT\text{-}est}$ and IGmax(f)$_{CUR\text{-}est}$ are the long term and current estimates, and IGDIFF_THR is a predefined threshold value for the sum of differences. If YES, the ear mould is correctly mounted, if NO, it is not.

In an embodiment, a convergence algorithm for deciding when the estimate of current feedback based on an applied probe signal has converged is applied (thereby providing a measurement end-time, and thus (possibly) an end-time of activation of the probe signal generator).

An exemplary convergence decision algorithm is:

For every time instant:

if FBE$_{CUR}(t_n f)$≥FBE$_{CUR}(t_{n-1} f)$, then GTEcounter=GTEcounter+1 else

LTcounter=LTcounter+1 if (GTEcounter≥THRcounter1) AND (LTcounter≥THRcounter2), then Estimate has converged else Continue measurement where GTEcounter and LTcounter are counters of instances where the later estimate FBE$_{CUR}$($t_n$,f) is larger than or equal to the earlier estimate FBE$_{CUR}$($t_{n-1}$, f) AND the number of times the earlier estimate is larger than the later estimate, respectively. THRcounter1 and THRcounter2 are threshold values that may be equal or different for the GTEcounter and LTcounter (and be constant or variable over frequency).

When both counters are greater than a threshold value, (THRcounter being e.g. 4) at a given sampling frequency $f_s$ ($f_s$ being e.g. 40 Hz), it is assumed that the estimate is stable (converged). A minmum convergence time is hence 2*THRcounter/$f_s$, which for the given example leads to a minimum convergence time of (2*4)/40=200 ms. Other threshold values than 4 may of course be chosen, e.g. 8 or larger, e.g. optimizing such value to the application in question with a view to acceptable time of duration and adaptation rate of the feedback estimation algorithm. In an embodiment, the threshold value is adaptively determined according to the adaptation rate of the feedback estimation algorithm.

Figure 10:
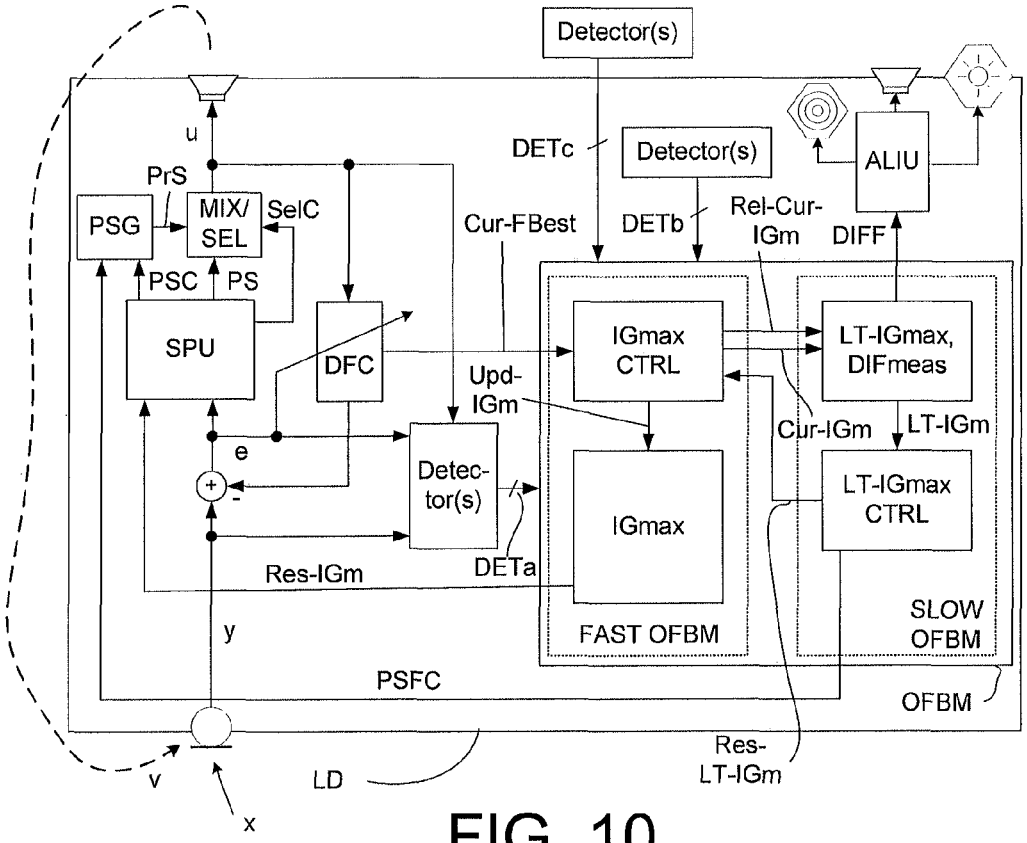
FIG. 10 shows an embodiment of a listening device according to the present disclosure.

FIG. 10 shows an embodiment of a listening device (LD) according to the present disclosure. The listening device comprises a forward path between a microphone for converting an input sound to an electric input signal y and a loudspeaker for converting a processed electric signal u to an output sound, the forward path comprising a signal processing unit SPU for processing an input signal e and providing a processed output signal PS. The listening device further comprises a probe signal generator PSG for generating a probe signal PrS adapted to be used in an estimation of the feedback path (signal v) from the speaker to the microphone. The activation and control of the probe signal generator PSG is performed by the signal processing unit SPU via signal PSC (or alternatively or additionally via a user interface, cf. e.g. FIG. 1*f*, 1*g*). The forward path further comprises a mixer/selector unit MIX/SEL for mixing or selecting between inputs PrS (probe signal) and PS (processed signal from the signal processing unit). The mixer/selector unit MIX/SEL is controlled by the signal processing unit SPU via signal SelC (or alternatively or additionally via a user interface). The listening device further comprises an adaptive feedback estimation unit DFC for dynamically estimating a feedback path from the loudspeaker to the microphone. The adaptive feedback estimation unit DFC provides an estimate signal v□ of the current feedback path, which is subtracted from the electric input signal y (comprising feedback signal v and additional ('target') signal x) from the microphone in combination unit '+' providing a feedback corrected error signal e, which is fed to the signal processing unit SPU and used in the feedback estimation unit DFC together with the output signal u to estimate the current feedback path. The listening device may preferably comprise more than one microphone and possibly more than one feedback estimation block (cf. e.g. FIG. 1*e*). Additionally, the listening device comprises an online feedback manager (OFBM) and a number of detectors (Detector(s)). The detectors monitor parameters or properties of the acoustic environment of the listening device and/or of a signal of the listening device, each detector providing one or more detector signals (DETa, DETb, DETc). The detector signals (DETa, DETb, DETc) are fed to the online feedback manager (OFBM) for evaluation. The detectors are e.g. adapted to monitor various parameters or properties (e.g. autocorrelation, cross-correlation, loop gain) of the signal of the forward path (cf. Detector(s) generating detector signal DETa) and/or of the acoustic environment and/or of the current mode of operation of the listening device. The detectors may be (physically) internal or external to the listening device. A detector signal (e.g. DETc in FIG. 10) may be received from an external sensor, e.g. wirelessly received using a wireless receiver unit in the listening device. The online feedback manager (OFBM) comprises a fast and a slow online feedback manager (FAST OFBM and SLOW OFBM, respectively). The FAST OFBM comprises a control unit (IGmax CTRL) for—based on signals from the detectors—extracting a reliable current IGmax value (output signal Rel-Cur-IGm) from a (current or instant) feedback path estimate (signal Cur-FBest) from the DFC system (DFC) (cf. also FIG. 5), which is fed to the SLOW OFBM. The control unit (IGmax CTRL) further determines a current IGmax value (e.g. based on the current or instant feedback path estimate (signal Cur-FBest) received from the DFC) representing the current acoustic situation of the listening device (be it reliable/representative or not), i.e. without having been 'filtered' by a reliability criterion based on signals from the detectors. These current ('unfiltered') IGmax values are also fed to the SLOW OFBM (output signal Cur-IGm). The FAST OFBM further comprises a unit (IGmax) for storing (updated) values of (current, reliable) IGmax values (cf. signal Upd-IGm) at different frequencies received from the control unit (IGmax CTRL). The signal processing unit SPU relies on the IGmax values of the IGmax unit of the FAST OFBM (cf. signal Res-IGm) in the determination of the gain of the forward path in a given acoustic situation. The SLOW OFBM comprises a calculation unit (LT-IGmax, D/Fineas) for determining a reliable long term IGmax value (for each frequency considered) from the reliable current IGmax values (signal Rel-Cur-IGm), e.g. as a moving average of reliable current IGmax values stored over a predefined time (e.g. days). The calculation unit is adapted to determine a feedback difference measure (signal DIFF) based on a difference between the reliable long term IGmax values and the instant or current IGmax values (signal Cur-IGm). The listening device further comprises an alarm indication unit (ALIU) adapted to issue an alarm indication based on the feedback difference measure (signal DIFF) to a user or a caring person. The alarm indication may e.g. be an acoustic sound, a visual indication and/or a mechanical vibration, as indicated by the corresponding symbols in FIG. 10. The loudspeaker used by the alarm unit ALIU provides an acoustic indication may e.g. be the same as the one used in the forward path. The SLOW OFBM further comprises a 'learning unit' LT-IGmax CTRL for—based on input signal LT-IGm representing reliable long term IGmax values—providing such reliable long term IGmax values to the control unit (IGmax CTRL), cf. signal Res-LT-IGm according to a predefined scheme (e.g. with a predefined update frequency or when specific conditions are met or initiated via a user or programming interface). Thereby reliable (slowly varying) IGmax values may be 'fed back' and used in the signal processing unit controlled by the control unit (IGmax CTRL), e.g. updated with a small update frequency intended to adapt IGmax to the changes of an ear canal due to a child's growth. Further, frequencies where maximum feedback occur and/or frequencies where minimum gain margin occur are forwarded to the probe signal generator PSG for possible use as tones in the probe signal PrS, cf signal PSFC from the 'learning unit' LT-IGmax CTRL.

Figure 11:
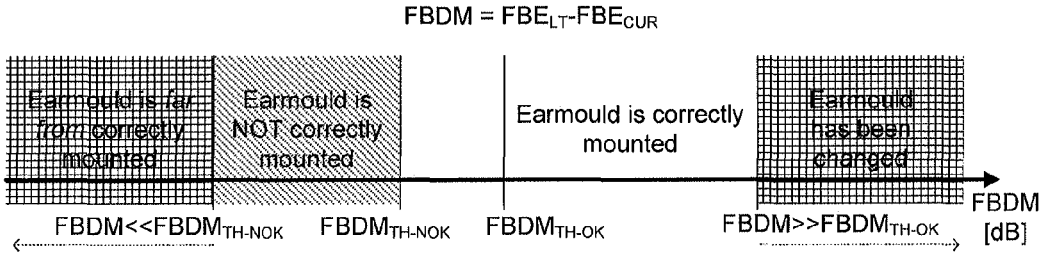
FIG. 11 illustrates criteria for deciding the mounting conditions for an ear mould based on a feedback difference measure FBDM.

FIG. 11 illustrates criteria for deciding the mounting conditions for an ear mould based on a feedback difference measure FBDM. The feedback difference measure reflects the difference between a long term feedback path estimate $FBE_{LT}$ and a current feedback path estimate $FBE_{CUR}$. FIG. 11 summarizes possible criteria for deciding whether or not a specific ear mould is properly mounted (or has been exchanged) in a particular situation (with given values of $FBE_{LT}$ and $FBE_{CUR}$). In an embodiment, the threshold values $FBDM_{TH\text{-}OK}$ and $FBDM_{TH\text{-}NOK}$ are equal. In an embodiment, the threshold values $FBDM_{TH\text{-}OK}$ is equal to −2 dB. In an embodiment, the difference between $FBDM_{TH\text{-}OK}$ and $FBDM_{TH\text{-}NOK}$ is smaller than 3 dB, e.g. smaller than or equal to 2 dB or smaller than or equal to 1 dB. The relations x>>y and x<<y are intended to mean x is much larger than y and x is much smaller than y, respectively. In an embodiment, such relations are intended to be fulfilled, if x is at least 6 dB larger than y and if x is at least 6 dB smaller than y, respectively. As illustrated in FIG. 11, the ear mould is anticipated to be, respectively Not correctly mounted, if $FBDM<FBDM_{TH\text{-}NOK}$, Far from correctly mounted if $FBDM<<FBDM_{TH\text{-}NOK}$, and Correctly mounted if $FBDM>FBDM_{TH\text{-}OK}$.

If $FBDM>>FBDM_{TH\text{-}OK}$ it is taken as an indication that the ear mould may have been exchanged with a new and better fitting one.

In an embodiment, the alarm indication varies according to the current value of the feedback difference measure FBDM. In an embodiment, the alarm indication is different at least for situations where $FBDM<FBDM_{TH\text{-}NOK}$, and $FBDM>FBDM_{TH\text{-}OK}$. In an embodiment, the alarm indication is different for the different ranges of FBDM shown in FIG. 11, e.g. at least for situations where $FBDM<<FBDM_{TH\text{-}NOK}$, $FBDM<FBDM_{TH\text{-}NOK}$ but FBDM is $NOT<<FBDM_{TH\text{-}NOK}$, $FBDM_{TH\text{-}NOK}<FBDM<FBDM_{TH\text{-}OK}$, $FBDM>FBDM_{TH\text{-}OK}$, but FBDM is $NOT>>FBDM_{TH\text{-}OK}$, and $FBDM>>FBDM_{TH\text{-}Ok}$. In an embodiment, the alarm indication varies continuously (or in small steps) with the value of the feedback difference measure FBDM (e.g. to provide faster beeps or light blinks the larger the feedback difference measure, or to provide faster beeps or light blinks, the closer the feedback difference measure is on a threshold value, e.g. $FBDM_{TH\text{-}OK}$. In an embodiment, a predefined scheme for indicating positive and negative information (e.g. OK, not OK, respectively) is used. In an embodiment a predefined colour scheme for visual indication is used (e.g. implemented by one or more light emitting diodes, LEDs), e.g. green=OK, red=NOK. In an embodiment, the scheme further comprises a third indicator, e.g. yellow or blue indicating an intermediate or indefinite or not yet finished result or no change.

Example

Fitting

In an embodiment, an initial indication of the fitting of an ear mould during a first time fitting of the ear mould in question to a user (e.g. at an audiologist) can be provided by a listening device according to the present disclosure.

By applying a probe signal as disclosed in the present application (e.g. as is done in connection with a start-up procedure after a power-off period, e.g. by playing a number of selected different tones), an initial (relatively fast) indication of the fitting of an ear mould during a fitting session can be provided. Assuming that an audiologist or other skilled person has ensured that the mould is correctly mounted in the ear of the user, a conclusion can be drawn from the result of the feedback estimate based on the application of the probe signal. Assuming that an initial long term feedback estimate or $IG_{max,LT}$ is stored in the listening device, the current feedback estimate based on the probe signal can be compared with the long term estimate (cf. e.g. the feedback difference measure according to the present disclosure). The initial long term estimate can e.g. be based on general data from the manufacturer of the listening device (maximum feedback estimates, etc.), average user data, and/or on a user's hearing profile, e.g. a maximum prescribed gain $IG_{max}(f)$ (e.g. in a quiet environment ('soft gain'), e.g. including a safety margin, e.g. including a possible volume gain applied by the user, etc.) at a number of frequencies distributed over the frequency range of operation of the listening device. An initial indication of the quality of the fitting of the ear mould can e.g. be based on the feedback difference measure FBDM, where the $FBE_{LTE}(f)$ is based on a stored initial value and the $FBE_{CUR}(f)$ is based on the initial probe signal feedback measurement. In case The feedback difference measure is within a predefined range, $FBDM_{FIT1} \geq FBDM \geq FBDM_{FIT2}$, it is assumed that the ear mould has an acceptable fit and the fitting procedure can be continued (including e.g. to measure the static part of the feedback path in more detail). If, however, this is not the case, it is concluded that the ear mould does not have an acceptable fit, and a decision in this regard must be taken.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

[Engebretson, 1993] A. Engebretson, M. French-St. George, "Properties of an adaptive feedback equalization algorithm", J. Rehabil. Res. Dev., 30(1), pp. 8-16, 1993.

[Joson et al., 1993] Harry Alfonso L. Joson, Futoshi Asano, Yōiti Suzuki, and Toshio Sone, Adaptive feedback cancellation with frequency compression for hearing aids, J. Acoust. Soc. Am., Vol. 94 (6), pp. 3248-3254, December 1993.

[Haykin] S. Haykin, Adaptive filter theory (Fourth Edition), Prentice Hall, 2001.

[Schaub; 2008] Arthur Schaub, Digital hearing Aids, Thieme Medical. Pub., 2008.

EP 2 088 802 A1 (OTICON)

U.S. Pat. No. 5,473,701 (AT&T)

WO 99/09786 A1 (PHONAK)

WO 2008/151970 A1 (OTICON) 18 Dec. 2008

WO 2009/007245 A1 (OTICON) 15 Jan. 2009

EP 1 718 110 A1 (OTICON) 2 Nov. 2006

EP 2 071 873 A1 (BERNAFON) 17 Jun. 2009

WO 2010/049543 A2 (PHONAK) 6 May 2010

The invention claimed is:

1. A method of detecting whether an ear mould of a listening device is correctly mounted in the ear of a user, the listening device comprising a forward path between an input transducer for converting an input sound to an electric input signal and an output transducer for converting an electric output signal to a stimulus perceived by the user as an output sound, the forward path comprising a signal processor for applying a frequency dependent gain to the electric input signal or a signal originating therefrom and for providing a processed signal, and feeding the processed signal or a signal originating therefrom to the output transducer;

an analysis path for analysing a signal of the forward path and estimating a feedback path from the output transducer to the input transducer, the method comprising:

providing a long term estimate of the feedback path;

providing a probe signal, which can be directly relayed to the environment of the listening device by the output transducer;

providing an estimate of the current feedback path based on said probe signal; and comparing the long term feedback path estimate with the current feedback path estimate, and providing a measure of their difference, termed the feedback difference measure FBDM, wherein the probe signal comprises one or more tones located at one or more predefined frequencies $f_1, f_2, \ldots, f_{NT}$, a first selected tone of frequency $f_1$ is played at a first time $t_1$, and a second selected tone of frequency $f_2$ is played at a second time $t_2$, and the time interval ($\Delta = t_2 - t_1$) between the playing of the first and second tones is sufficiently long to ensure that the feedback path estimate at the first frequency ft has converged.

2. A method according to claim 1, wherein a first adaptation rate $AR_1$ of the adaptive algorithm of the feedback path estimate is used during an initial, first part of the time interval $\Delta t$ and a second adaptation rate $AR_2$ is used during a second part of the time interval $\Delta t$, said first adaptation rate $AR_1$ being larger than said second adaptation rate $AR_2$.

3. A method according to claim 1 wherein an initial indication of the fitting of an ear mould during a first time fitting of the ear mould in question to a user is provided.

4. A method according to claim 3, wherein an initial long term feedback estimate or $IG_{max,LT}$ is stored in the listening device, and a current feedback estimate based on the probe signal is compared with the initial long term estimate, whereby—when an audiologist or other skilled person has ensured that the ear mould is correctly mounted in the ear of the user—a conclusion concerning the quality of the fitting of the ear mould can be drawn.

5. A listening device comprising an ear mould adapted for being mounted in the ear of a user, comprising:

a forward path between an input transducer converting an input sound to an electric input signal and an output transducer for converting an electric output signal to an output sound, the forward path comprising a signal processor for applying a frequency dependent gain to the electric input signal or a signal originating therefrom and for providing a processed signal, and feeding the processed signal or a signal originating therefrom to the output transducer;

an analysis path for analysing a signal of the forward path and comprising a feedback estimator for estimating a feedback path from the output transducer to the input transducer;

a probe signal generator for generating a probe signal and adapted to allow a relay of the probe signal directly to the environment of the listening device by the output transducer;

a feedback management unit for a) providing a long term estimate of the feedback path;

b) providing an estimate of the current feedback path based on said probe signal; and c) comparing the long term feedback path estimate with the current feedback path estimate, and providing a measure for their difference, wherein the probe signal comprises one or more tones located at one or more predefined frequencies $f_1, f_2, \ldots, f_{NT}$, the probe signal generator is configured to generate a first selected tone of frequency $f_1$ at a first time $t_1$, and to generate a second selected tone of frequency $f_2$ at a second time $t_2$, and a time interval, $\Delta=t_2-t_1$, between the generating of the first and second tones has a duration that ensures that the feedback path estimate at the first frequency $f_1$ has converged.

6. The listening device according to claim 5, wherein a first adaptation rate $AR_1$ of the adaptive algorithm of the feedback path estimate is used during an initial, first part of the time interval $\Delta t$ and a second adaptation rate $AR_2$, smaller than $AR_1$, is used during a second part of the time interval $\Delta t$.

7. The listening device according to claim 5, comprising:

a hearing aid, a headset, an earphone, an ear protection device or a combination thereof.

8. A method of detecting whether an ear mould of a listening device is correctly mounted in the ear of a user, the listening device comprising a forward path between an input transducer for converting an input sound to an electric input signal and an output transducer for converting an electric output signal to a stimulus perceived by the user as an output sound, the forward path comprising a signal processor for applying a frequency dependent gain to the electric input signal or a signal originating therefrom and for providing a processed signal, and feeding the processed signal or a signal originating therefrom to the output transducer; and an analysis path for analysing a signal of the forward path and estimating a feedback path from the output transducer to the input transducer, the method comprising:

a) providing a long term estimate of the feedback path;

b) providing a probe signal, which can be relayed to the environment of the listening device by the output transducer;

c) providing an estimate of the current feedback path based on said probe signal; and d) comparing the long term feedback path estimate with the current feedback path estimate, and providing a measure of their difference, termed the feedback difference measure FBDM, wherein the probe signal comprises one or more tones located at one or more predefined frequencies $f_1, f_2, \ldots, f_{NT}$, the level and/or duration of the tones and/or order in which the tones are played when activating the probe signal depend(s) on the level of the input signal of the frequency channel(s) wherein the probe signal tone(s) in question is/are located, and the current feedback path estimate is used to detect whether the ear mould has been replaced, and to subsequently update the long term feedback path estimate.

9. A method of detecting whether an ear mould of a listening device is correctly mounted in the ear of a user, the listening device comprising a forward path between an input transducer for converting an input sound to an electric input signal and an output transducer for converting an electric output signal to a stimulus perceived by the user as an output sound, the forward path comprising a signal processor for applying a frequency dependent gain to the electric input signal or a signal originating therefrom and for providing a processed signal, and feeding the processed signal or a signal originating therefrom to the output transducer; and an analysis path for analysing a signal of the forward path and estimating a feedback path from the output transducer to the input transducer, the method comprising:

a) providing a long term estimate of the feedback path;

b) providing a probe signal, which can be relayed to the environment of the listening device by the output transducer;

c) providing an estimate of the current feedback path based on said probe signal; and d) comparing the long term feedback path estimate with the current feedback path estimate, and providing a measure of their difference, termed the feedback difference measure FBDM, wherein the probe signal comprises one or more tones located at one or more predefined frequencies $f_1, f_2, \ldots, f_{NT}$, the level and/or duration of the tones and/or order in which the tones are played when activating the probe signal depend(s) on the level of the input signal of the frequency channel(s) wherein the probe signal tone(s) in question is/are located, and wherein said input signal is a mixture of an acoustic input signal and a feedback signal received by the input transducer, the feedback signal including the one or more tones of the probe signal which have propagated from the output transducer along the feedback path.

10. A method according to claim 9 comprising:

providing the long term estimate of the feedback path and/or the current feedback path at a number NI of feedback calculation frequencies $f_1, f_2, \ldots, f_{NI}$.

11. A method according to claim 10 wherein the feedback difference measure depends on the difference between the long term feedback path estimate and the current feedback path estimate determined at a number of frequencies comprising at least some of said feedback calculation frequencies $f_1, f_2, \ldots, f_{NI}$.

12. A method according to claim 10 wherein the probe signal comprises one or more tones located at one or more of said feedback calculation frequencies $f_1, f_2, \ldots, f_{NI}$, where the current feedback path is estimated.

13. A method according to claim 12, wherein the long term feedback path estimate and/or the current feedback path estimate is/are based on an adaptive algorithm.

14. A method according to claim 12, wherein the current feedback path estimate is based on an open loop estimation where the probe signal is played by a loudspeaker of the listening device.

15. A method according to claim 12, wherein the probe signal comprises a number of tones located at the frequencies exhibiting largest long term feedback path estimates.

16. A method according to claim 9, wherein the probe signal comprises the electric input signal picked up by the input transducer of the listening device.

17. A method according to claim 16, wherein the electric input signal comprises a wirelessly received signal from an auxiliary device.

18. A method according to claim 9, wherein the probe signal is applied in a particular mode of the listening device, or at the request of a user.

19. The method according to claim 18, wherein the probe signal is applied as part of a start-up procedure.

20. A method according to claim 9, wherein the current and/or long term feedback path estimate is based on a closed loop estimation based on external sounds and/or internally generated probe signals.

21. A method according to claim 9, wherein the long term feedback path estimate is determined based on values of the current feedback path estimate stored in a memory of the listening device.

22. A method according to claim 9, further comprising:

providing an alarm indication, if the feedback difference measure fulfils a predefined criterion.

23. A method according to claim 9, wherein the initial long term estimate is based on a user's hearing profile, including a maximum prescribed gain $IG_{max}(f)$ in a quiet environment including a possible volume gain applied by the user at a number of frequencies distributed over the frequency range of operation of the listening device.

24. The method according to claim 9, wherein the long term feedback path estimate comprises a measured feedback path estimate.

25. The method according to claim 9, wherein the probe signal is applied at the request of a user initiated via a user interface.

26. The method according to claim 9, wherein the probe signal is applied at the request of a user and initiated via a remote control.

27. The method according to claim 9, wherein the one or more tones are composed to form a melody.

28. The method according to claim 27, wherein the melody used to measure the current feedback path also indicates a specific status or event of the listening device.

29. The method according to claim 28, wherein the melody is a start-up melody, indicating to the user that the listening device is in the process of being initialized and/or to be fully functional, when the melody terminates.

30. The method according to claim 9, wherein the providing of the probe signal includes:

repeatedly playing the probe signal as a loop until a determination is made that the ear mould of the listening device has been correctly mounted.

31. A data processing system comprising:

a processor; and a non-transitory tangible memory encoded with instructions for causing the processor to perform the steps of the method of claim 9.

32. A listening device comprising an ear mould adapted to be mounted in the ear of a user, comprising a forward path between an input transducer for converting an input sound to an electric input signal and an output transducer for converting an electric output signal to a stimulus perceived by the user as an output sound, the forward path comprising a signal processor for applying a frequency dependent gain to the electric input signal or a signal originating therefrom and for providing a processed signal, and feeding the processed signal or a signal originating therefrom to the output transducer;

an analysis path for analysing a signal of the forward path and comprising a feedback estimator for estimating a feedback path from the output transducer to the input transducer; and a feedback manager configured to:

a) provide a long term estimate of the feedback path;

b) provide a probe signal, which can be relayed to the environment of the listening device by the output transducer;

c) provide an estimate of the current feedback path based on said probe signal; and d) compare the long term feedback path estimate with the current feedback path estimate, and providing a measure of their difference, termed the feedback difference measure FBDM, wherein the probe signal comprises one or more tones located at one or more predefined frequencies $f_1, f_2, \ldots, f_{NT}$, the level and/or duration of the tones and/or order in which the tones are played when activating the probe signal depend(s) on the level of the input signal of the frequency channel(s) wherein the probe signal tone(s) in question is/are located, and wherein said input signal is a mixture of an acoustic input signal and a feedback signal received by the input transducer, the feedback signal including the one or more tones of the probe signal which have propagated from the output transducer along the feedback path.

33. A listening device according to claim 32 comprising an alarm indication unit for providing an alarm indication, if the feedback difference measure exceeds a predefined threshold.

34. A listening device according to claim 33 adapted to provide that the alarm indication indicates a degree of fitting of the ear mould.

35. The listening device according to claim 32, further configured to provide that a degree of fitting of the ear mould is dynamically indicated by the listening device and/or by another device in communication with the listening device.

36. The listening device according to claim 32, comprising:

a hearing aid, a headset, an earphone, an ear protection device or a combination thereof.

37. The listening device according to claim 32, further configured to provide that the probe signal comprises an input signal picked up by an input transducer of the listening device and is used to determine a current feedback path.

38. The listening device according to claim 32, further configured to provide that a signal wirelessly received from an auxiliary device is used in the listening device as the probe signal to determine a current feedback path.

39. The listening system according to claim 38, wherein the auxiliary device comprises a probe signal generator for applying a probe signal to the output signal of the listening device.

40. The listening device according to claim 38, wherein the auxiliary device is at least one of one of an external microphone, an audio delivery service, an audio gateway, a music player, and a telephone.

41. The listening device according to claim 32, wherein the user interface comprises an activation element that allows a user to influence the operation of the listening device and/or otherwise provide a user input without using a button.

42. The listening device according to claim 41, wherein the activation element comprises a movement sensor.

43. The listening device according to claim 42, wherein the movement sensor is an acceleration sensor.

44. A listening system comprising a listening device according to claim 32 AND an auxiliary device, the listening device and the auxiliary device being adapted to establish a communication link between them to provide that information can be exchanged or forwarded from one to the other.

45. A listening system according to claim 44 wherein an alarm indication concerning the degree of fitting of the ear mould of a listening device of the system is provided in the auxiliary device.

46. A listening system according to claim 44 adapted to provide that the probe signal generator for applying a probe signal to the output signal of the listening device(s) is controllable from the auxiliary device.

47. The listening system according to claim 44 wherein the auxiliary device comprises a probe signal generator for applying a probe signal to the output signal of the listening device.

48. A listening device comprising an ear mould adapted for being mounted in an ear of a user, comprising a forward path between an input transducer for converting an input sound to an electric input signal and an output transducer for converting an electric output signal to a stimulus perceived by the user as an output sound, the forward path comprising a signal processor for applying a frequency dependent gain to the electric input signal or a signal originating therefrom and for providing a processed signal, and feeding the processed signal or a signal originating therefrom to the output transducer; and an analysis path for analysing a signal of the forward path and estimating a feedback path from the output transducer to the input transducer, a feedback management unit for providing a long term estimate of the feedback path;

providing a probe signal, which can be relayed to the environment of the listening device by the output transducer;

providing an estimate of the current feedback path based on said probe signal; and comparing the long term feedback path estimate with the current feedback path estimate, and providing a measure of their difference, termed the feedback difference measure FBDM, wherein the probe signal comprises one or more tones located at one or more predefined frequencies $f_1, f_2, \ldots, f_{NT}$, the level and/or duration of the tones and/or order in which the tones are played when activating the probe signal depend(s) on the level of the input signal of the frequency channel(s) wherein the probe signal tone(s) in question is/are located, and the current feedback path estimate is used to detect whether the ear mould has been replaced, and to subsequently update the long term feedback path estimate.

49. The listening device according to claim 48, comprising:

a hearing aid, a headset, an earphone, an ear protection device or a combination thereof.

* * * * *